US006371303B1

(12) United States Patent
Klein et al.

(10) Patent No.: US 6,371,303 B1
(45) Date of Patent: Apr. 16, 2002

(54) TWO BELT BILL FACING MECHANISM

(75) Inventors: Robert J. Klein, Chicago; George T. Seelenbinder, Elk Grove Village; Charles P. Jenrick, Chicago, all of IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 09/503,039

(22) Filed: Feb. 11, 2000

(51) Int. Cl.[7] ..... B07C 5/00; B65H 29/00

(52) U.S. Cl. ..... 209/534; 209/541; 209/900; 271/186

(58) Field of Search ..... 209/534, 540, 209/541, 545, 900; 271/184, 185, 186

(56) References Cited

U.S. PATENT DOCUMENTS

| | | | | |
|---|---|---|---|---|
| 2,145,786 | A | 1/1939 | Birkmeyer | |
| 3,280,995 | A | 10/1966 | Barkley | |
| 3,726,386 | A | 4/1973 | Chisholm | |
| 3,767,028 | A | 10/1973 | Rosso | |
| 3,930,581 | A | 1/1976 | Gray | 209/73 |
| 4,226,324 | A | 10/1980 | Stocker | |
| 4,381,447 | A | 4/1983 | Horvath et al. | 250/223 |
| 4,398,088 | A | 8/1983 | Hirose et al. | 235/379 |
| 4,465,192 | A | 8/1984 | Ohba et al. | 209/534 |
| 4,479,574 | A | 10/1984 | Julius et al. | |
| 4,520,932 | A | 6/1985 | Matsuda et al. | |
| 4,524,268 | A | 6/1985 | Fukatsu | 235/379 |

(List continued on next page.)

FOREIGN PATENT DOCUMENTS

| | | |
|---|---|---|
| GB | 818684 | 8/1959 |
| JP | 54-51598 | 4/1979 |

OTHER PUBLICATIONS

Billcon Brochure: Note Counter with Detection K–100 series.

CSI, Inc. Web Page: CashCat Desktop Sorter and Specifications.

CSI, Inc. Web Page: CPS 300–600 and Specifications.

CSI, Inc. Web Page: CPS 900 and Specifications.

CSI, Inc. Web Page: CPS 1200–1500–1800 and Specifications.

Mosler Brochure: TouchSort Currency Processing System—One Touch One Pass One Solution.

Toyocom Brochure: NC–50 Currency Counter.

Toyocom Brochure: NS–200 Currency Recognizer.

Glory UW–200 Multipurpose Compact Currency Sorter, 4 pages, ©1999.

(List continued on next page.)

*Primary Examiner*—Tuan N. Nguyen
(74) *Attorney, Agent, or Firm*—Jenkens & Gilchrist

(57) ABSTRACT

An apparatus for rotating a bill approximately 180° includes a first and a second belt. The first belt has a bill transport portion, a return portion, a first end, and a second end. The second end of first belt being twisted approximately 180° in relation to the first end of the first belt. The second belt has a bill transport portion, a return portion, a first end, and second end. The bill transport portion of the first belt is disposed adjacent to the bill transport portion of the second belt. The second end of second belt is twisted approximately 180° in relation to the first end of the second belt. A bill transport path is defined by the bill transport portions of the first and the second belts. The bill transport path has an inlet and an outlet. The outlet of the bill transport path is twisted approximately 180° in relation to the inlet. A plurality of guides are disposed adjacent to the bill facing path for supporting the outer portions of the bill which extend beyond a width of the first and the second belts as the bill is being transported along the transport path.

18 Claims, 27 Drawing Sheets

U.S. PATENT DOCUMENTS

| | | | | |
|---|---|---|---|---|
| 4,533,824 | A | 8/1985 | Watanabe | 235/379 |
| 4,542,829 | A | 9/1985 | Emery et al. | 209/534 |
| 4,571,489 | A | 2/1986 | Watanabe | 235/379 |
| 4,587,408 | A | 5/1986 | Watanabe | 235/379 |
| 4,594,502 | A | 6/1986 | Watanabe | 235/379 |
| 4,629,382 | A | 12/1986 | Ueshin | 414/48 |
| 4,690,268 | A | 9/1987 | Ueshin | 198/399 |
| 4,697,071 | A | 9/1987 | Hiraoka et al. | 235/379 |
| 4,721,504 | A | 1/1988 | Cogsell et al. | |
| 4,787,518 | A | 11/1988 | Yuge et al. | 209/534 |
| 4,825,378 | A | 4/1989 | Yuge | 364/478 |
| 4,856,768 | A | 8/1989 | Hiroki et al. | 271/186 |
| 4,905,840 | A | 3/1990 | Yuge et al. | 209/534 |
| 4,971,310 | A | 11/1990 | Motegi et al. | 271/126 |
| 4,980,543 | A | 12/1990 | Hara et al. | 235/379 |
| 5,112,291 | A | 5/1992 | VeMehren | |
| 5,256,862 | A | 10/1993 | Watanabe et al. | 235/379 |
| 5,445,277 | A | 8/1995 | Takemoto et al. | 209/534 |
| 5,468,941 | A | * 11/1995 | Sasaki | 209/534 X |
| 6,012,565 | A | 1/2000 | Mazur | 194/207 |
| 6,021,883 | A | 2/2000 | Casanova et al. | 194/217 |
| 6,028,951 | A | 2/2000 | Raterman et al. | 382/135 |
| 6,074,334 | A | 6/2000 | Mennie et al. | 493/438 |

OTHER PUBLICATIONS

Glory UW–100 Compact Currency Fitness Sorter, 2 pages, ©1999.

Glory GFRT–1 Currency Scanner, 12/94.

Glory GFR–100 Currency Reader Counter Instruction Manual, 32 pages, Aug. 20, 1998.

Glory Brochure "Unstoppable" GFR–100 ReadMaster Currency Discriminator, 2 pages, 8/98.

Glory Brochure "Tank Tough Currency Discriminators" GFR–100 & GFB–700, 2 pages, Aug. 6, 1998.

Glory Brochure "Tank Tough Currency Discriminators" GFR–100 & GFR–S80, 2 pages, Dec. 7, 1999.

Glory UF–1D bank Note Depositing Machine, 2 pages, est. before Aug. 9, 1994.

Glory GFU–100 Desk–Top Currency Fitness Sorter/Counter, 2 pages, Jan. 14, 1994.

Glory Brochure "GFR–X Banknote Counter with Denomination", 3 pages, 12/94.

Glory GFR–100 Currency Reader Counter Instruction Manual, 30 pages, Aug. 15, 1995.

* cited by examiner

TWO BELT BILL FACING MECHANISM

FIELD OF THE INVENTION

The present invention relates generally to the field of currency handling systems and, more particularly, to a bill facing mechanism for used in a currency handling system.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly identifying, discriminating, and counting multiple currency denominations and then delivering the sorted currency bills into a multitude of output compartments. Many of these high end machines are extremely large and expensive such that they are commonly found only in large institutions. These machines are not readily available to businesses which have monetary and space budgets, but still have the need to process large volumes of currency. Other high end currency handling machines require their own climate controlled environment which may place even greater strains on businesses having monetary and space budgets.

Currency handling machines typically employ magnetic sensing or optical sensing for denominating and authenticating currency bills. The results of these processes determines to which output compartment a particular bill is delivered to in a currency handling device having multiple output receptacles. For example, ten dollar denominations may be delivered to one output compartment and twenty dollar denominations to another, while bills which fail the authentication test are delivered to a third output compartment. Unfortunately, many prior art devices only have one output compartment which can be appropriately called a reject pocket. Accordingly, in those cases, the reject pocket may have to accommodate those bills which fail a denomination test or authentication test. As a result, different types of "reject" bills are stacked upon one another in the same output compartment leaving the operator unknowing as to which of those bills failed which tests.

Many prior art large volume currency handling devices which positively transport the currency bills through the device are susceptible to becoming jammed. And many of these machines are difficult to un-jam because the operator must physically remove the bill from the device. If necessary, the operator can often manipulate a hand-crank to manually jog the device to remove the bills. Then, the operator must manually turn the hand crank to flush out all the bills from within the system before the batch can be reprocessed. Further compounding the problem in a jam situation is that many prior art devices are not equipped to detect the presence of a jam. In such a situation, the device continues to operate until the bills pile up and the jam is so severe that the device is forced to physically halt. This situation can cause physical damage to both the machine and the bills. Often, a jam ruins the integrity of the count and/or valuation of the currency bills so that the entire batch must be reprocessed.

Weight is another draw-back of prior art high-volume currency handling machines. In part, the weight of these machines is due to the heavy machinery used. For example, some machines contain large cast iron rails on which apparatuses ride to push currency bills down into the storage compartments. Unfortunately, the increased weight of these machines often translates into increased costs associated with the machine.

Another disadvantage to some prior art currency handling devices is the manner of feeding bills into the device. Many prior art devices only have one advance mechanism so the operator of the device can only process one stack of bills at a time before reloading the machine. Alternatively, the operator can attempt to simultaneously manipulate the stack of bills currently being processed, a new stack of bills, and the feeder mechanism.

SUMMARY OF THE INVENTION

According to one embodiment of the present invention, there is provided a multiple output receptacle currency handling device for receiving a stack of currency bills and rapidly processing all the bills in the stack, One aspect of the present invention is directed to an apparatus for rotating a bill approximately 180°. The apparatus comprises a first and a second belt. The first belt has a bill transport portion, a return portion, a first end, and a second end. The second end of first belt being twisted approximately 180° in relation to the first end of the first belt. The second belt has a bill transport portion, a return portion, a first end, and second end. The bill transport portion of the first belt is disposed adjacent to the bill transport portion of the second belt. The second end of second belt is twisted approximately 180° in relation to the first end of the second belt. A bill transport path is defined by the bill transport portions of the first and the second belts. The bill transport path has an inlet and an outlet. The outlet of the bill transport path is twisted approximately 180° in relation to the inlet. A plurality of guides are disposed adjacent to the bill facing path for supporting the outer portions of the bill which extend beyond a width of the first and the second belts as the bill is being transported along the transport path.

The above summary of the present invention is not intended to represent each embodiment, or every aspect, of the present invention. Additional features and benefits of the present invention will become apparent from the detail description, figures, and claim set forth below.

BRIEF DESCRIPTION OF THE DRAWINGS

Other objects and advantages of the invention will become apparent upon reading the following detailed description in conjunction with the drawings in which.

DETAILED DESCRIPTION OF THE ILLUSTRATED EMBODIMENTS

Figure 1A:
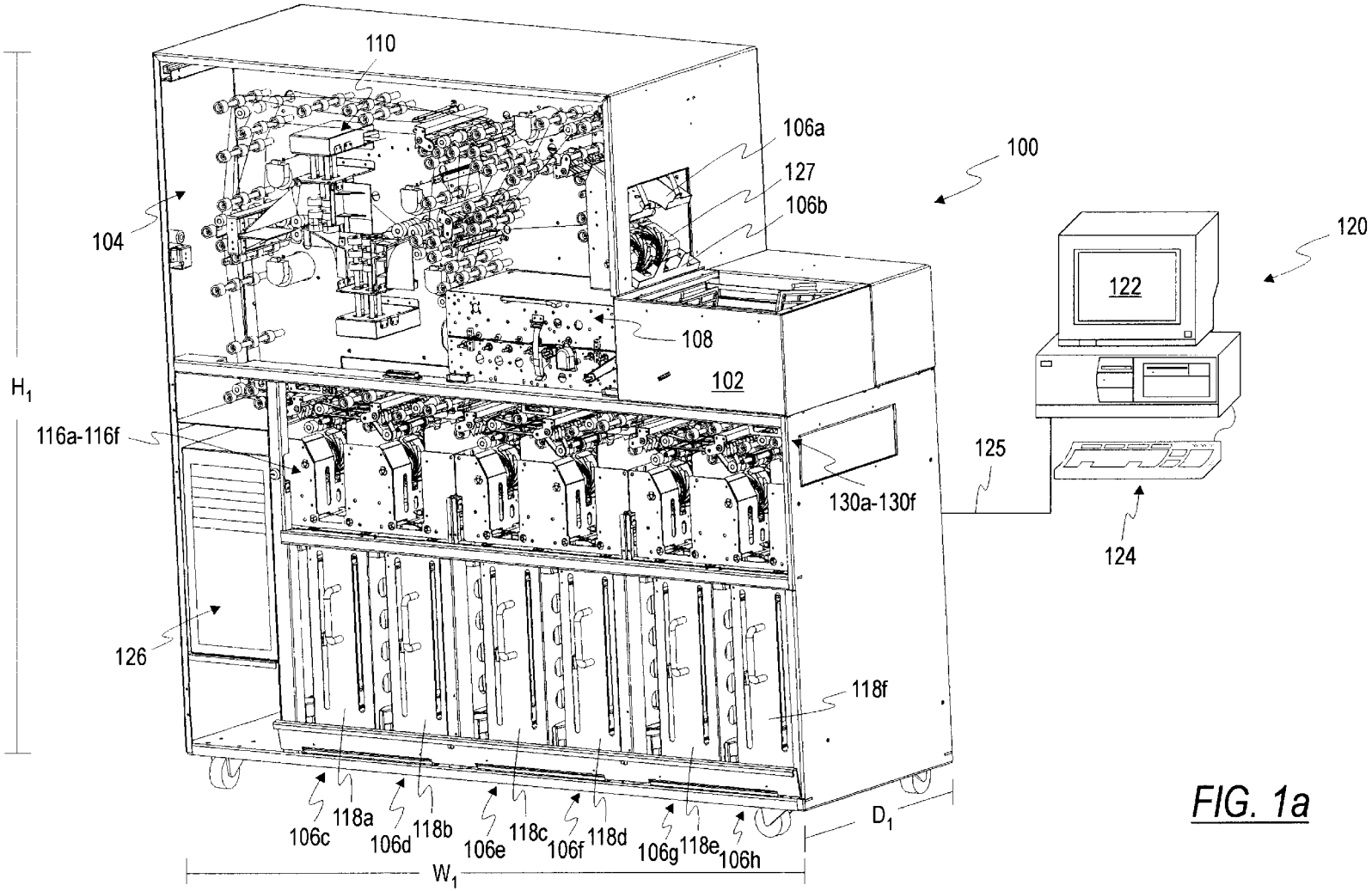
FIG. 1*a* is a perspective view of a document handling device according to one embodiment of the invention.
Figure 1B:
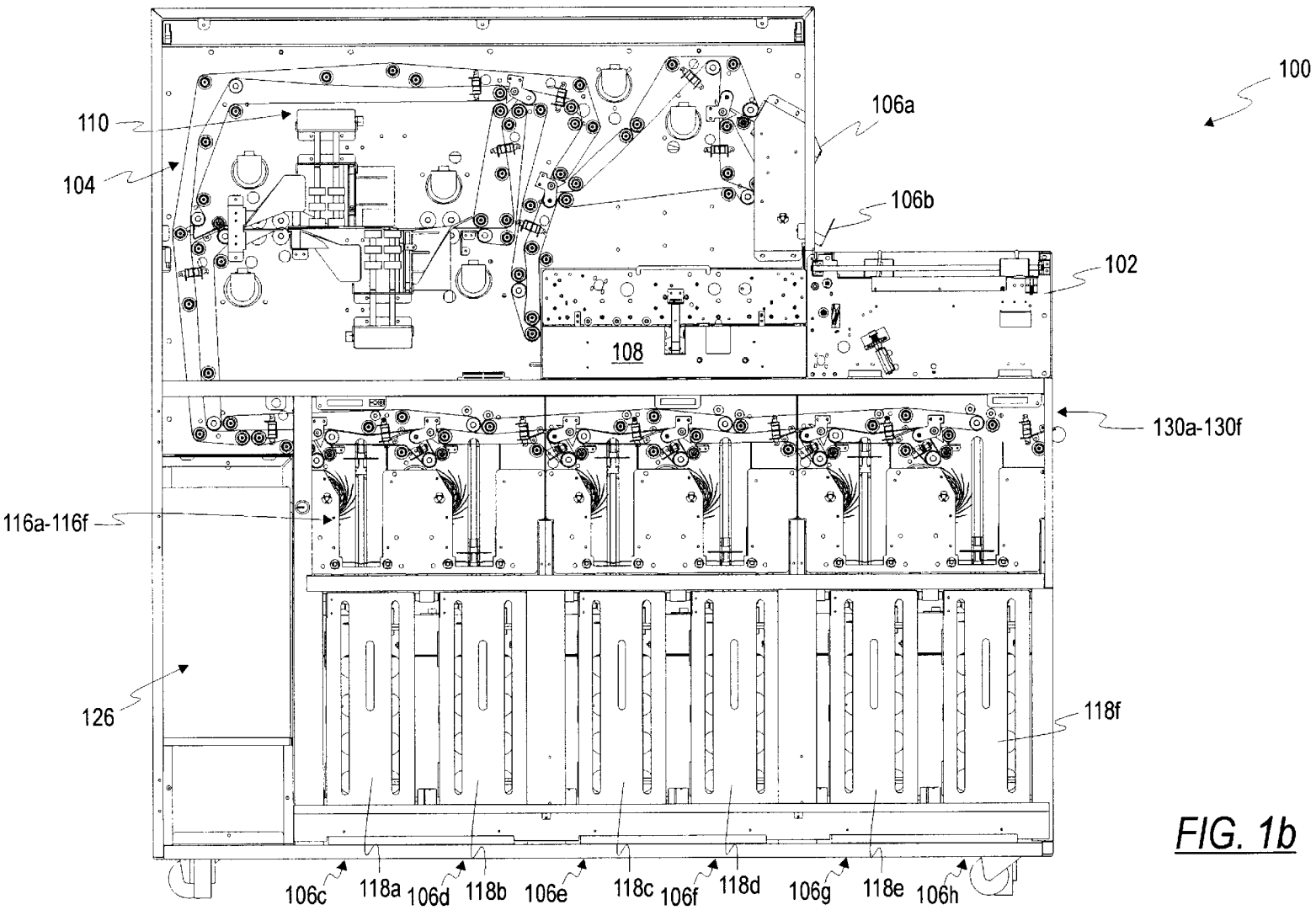
FIG. 1*b* is a front view of a document handling device according to one embodiment of the invention.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*–106*h*, which may include upper output receptacles 106*a*, 106*b*, as well as lower output receptacles 106*c*–106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute.

In the illustrated embodiment, interposed in the bill transport mechanism 104, intermediate the bill evaluation region 108 and the lower output receptacles 106*c*–106*h* is a bill facing mechanism designated generally by reference numeral 110. The bill facing mechanism is capable of rotating a bill 180° so that the face position of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The leading edge of the bill remains constant while the bill is being rotated 180° by the facing mechanism 110. The decision may be taken to send a bill to the facing mechanism 110 when the selected mode of operation or other operator instructions call for maintaining a given face position of bills as they are processed by the currency handling device 100. For example, it may be desirable in certain circumstances for all of the bills ultimately delivered to the lower output receptacles 106*c*–106*h* to have the bill surface bearing the portrait of the president facing up. In such embodiments of the currency handling device 100, the bill evaluation region 108 is capable of determining the face position of a bill, such that a bill not having the desired face position can first be directed to the facing mechanism 110 before being delivered to the appropriate output receptacle 106. Further details of a facing mechanism which may be utilized for this purpose are disclosed in commonly-owned, co-pending U.S. application Ser. No. 09/181,254, entitled "Document Facing Method and Apparatus" which was filed on Oct. 28, 1998, incorporated herein by reference in its entirety, which may be employed in conjunction with the present invention such as the device illustrated in FIGS. 1*a* and 1*b*. Other alternative embodiments of the currency handling device 100 do not include the facing mechanism 110.

The currency handling device 100 in FIG. 1 a may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*–106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination, accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*–106*h*. Those bills that were determined not to be authentic, suspect bills, would be delivered to the second upper output receptacle 106*b*. A multitude of user defined modes are disclosed by co-pending U.S. patent application Ser. No. 08/916,100 entitled "Multi-Pocket Currency Discriminator" which was filed on Aug. 21, 1997, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified note is flagged and "presented" in one of the output receptacles 106*a*–106*h*, that is, the transport mechanism 104 is stopped so that the unidentified bill is located at a predetermined position within one of the output receptacles 106*a*–106*h*, such as being the last bill transported to one of the output receptacles. Such criteria can include denominating information, authenticating information, information indicative of the bill's series, or other information the evaluation region 108 is attempting to obtain pursuant to a mode of operation. Which output receptacles 106*a*–106*h* the flagged bill is presented in may be determined by the user according to a selected mode of operation. For example, where the unidentified bill is the last bill transported to an output receptacle 106*a*–106*h*, it may be positioned within a stacker wheel or positioned at the top of the bills already within the output receptacle 106*a*–106*h*. While unidentified bills may be transported to any output receptacles 106*a*–106*h*, it may be more convenient for the operator to have unidentified bills transported to one of the upper output receptacles 106*a,b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*–106*h* a flagged bill is presented.

The currency handling device 100 may be designed to continue operation automatically when a flagged bill is removed from the upper output receptacle 106*a,b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a,b* until the batch of currency bills currently being processed is completed or the output receptacle 106*a,b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*–106*h*, respectively. Upon detection of the first British pound note, the currency handling device 100 may halt operation allowing the operator to empty the lower output receptacles 106*c*–106*h* and to make any spatial adjustments necessary to accommodate the British currency. A multitude of modes of operation are described in conjunction with bill flagging, presenting, and/or transport halting in commonly owned, co-pending U.S. patent application Ser. No. 08/916,100 entitled "Method and Apparatus for Document Processing" which was filed on May 28, 1997, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*–106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*, 106*b* are equipped with a stacker wheel. In such an embodiment both the upper output receptacles 106*a*,b may also function as the lower output receptacle 106*c*–106*h* allowing a number of bills to be stacked therein.

Figure 2A:
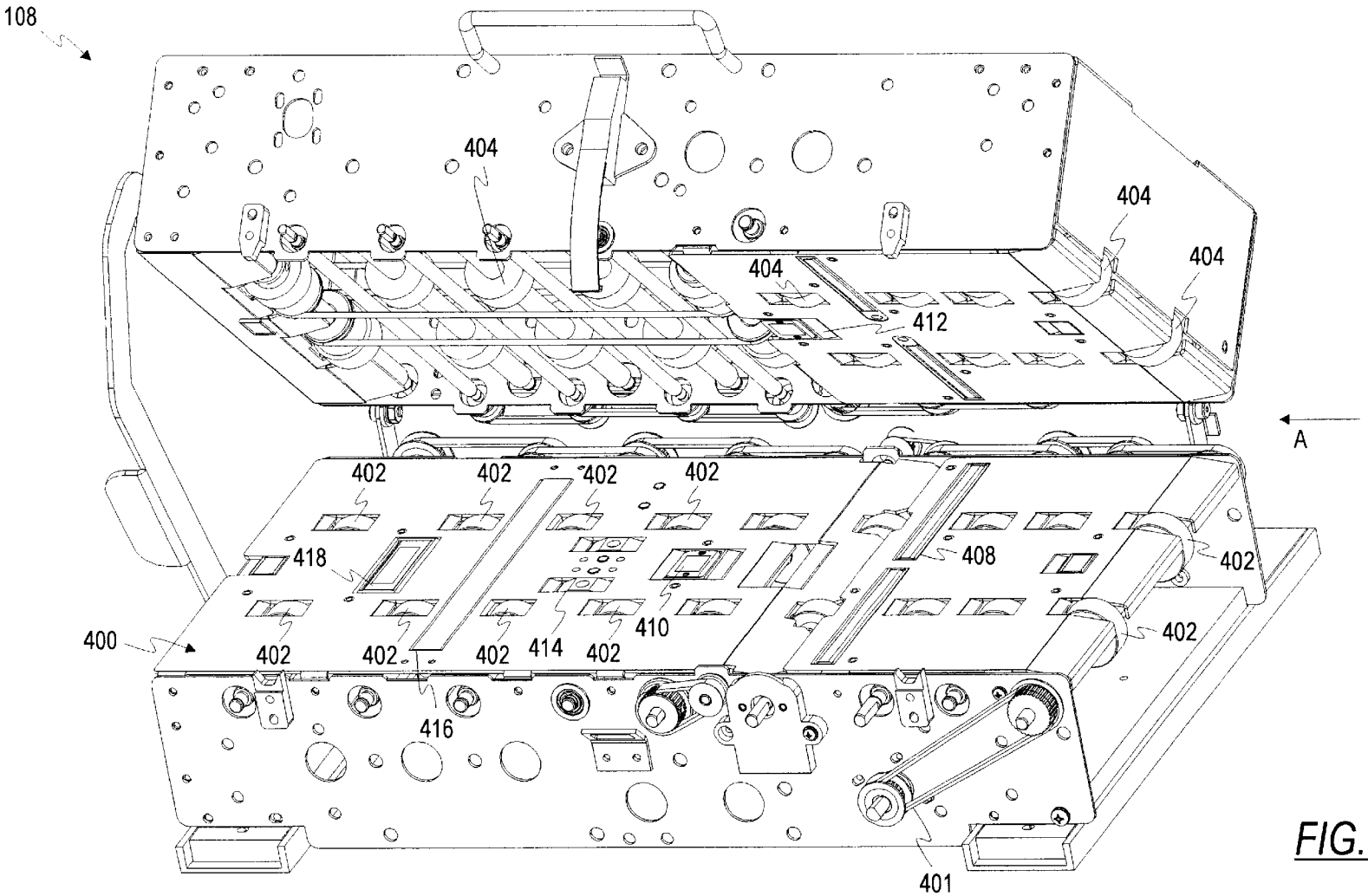
FIG. 2*a* is a perspective view of an evaluation region according to one embodiment of the document handling device of the present invention.
Figure 2B:
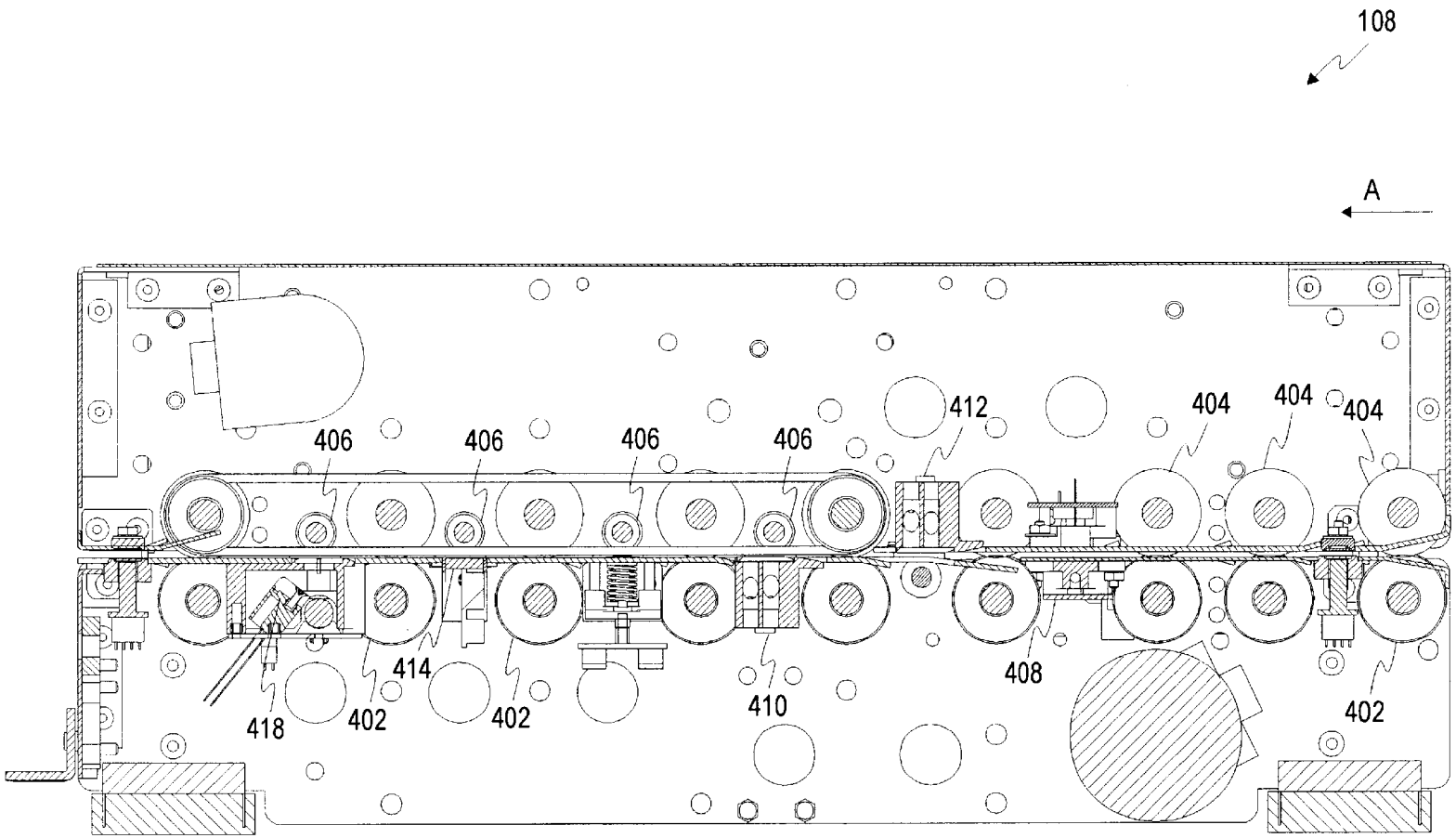
FIG. 2*b* is a side view of an evaluation region according to one embodiment of the document handling device of the present invention.
Figure 3A:
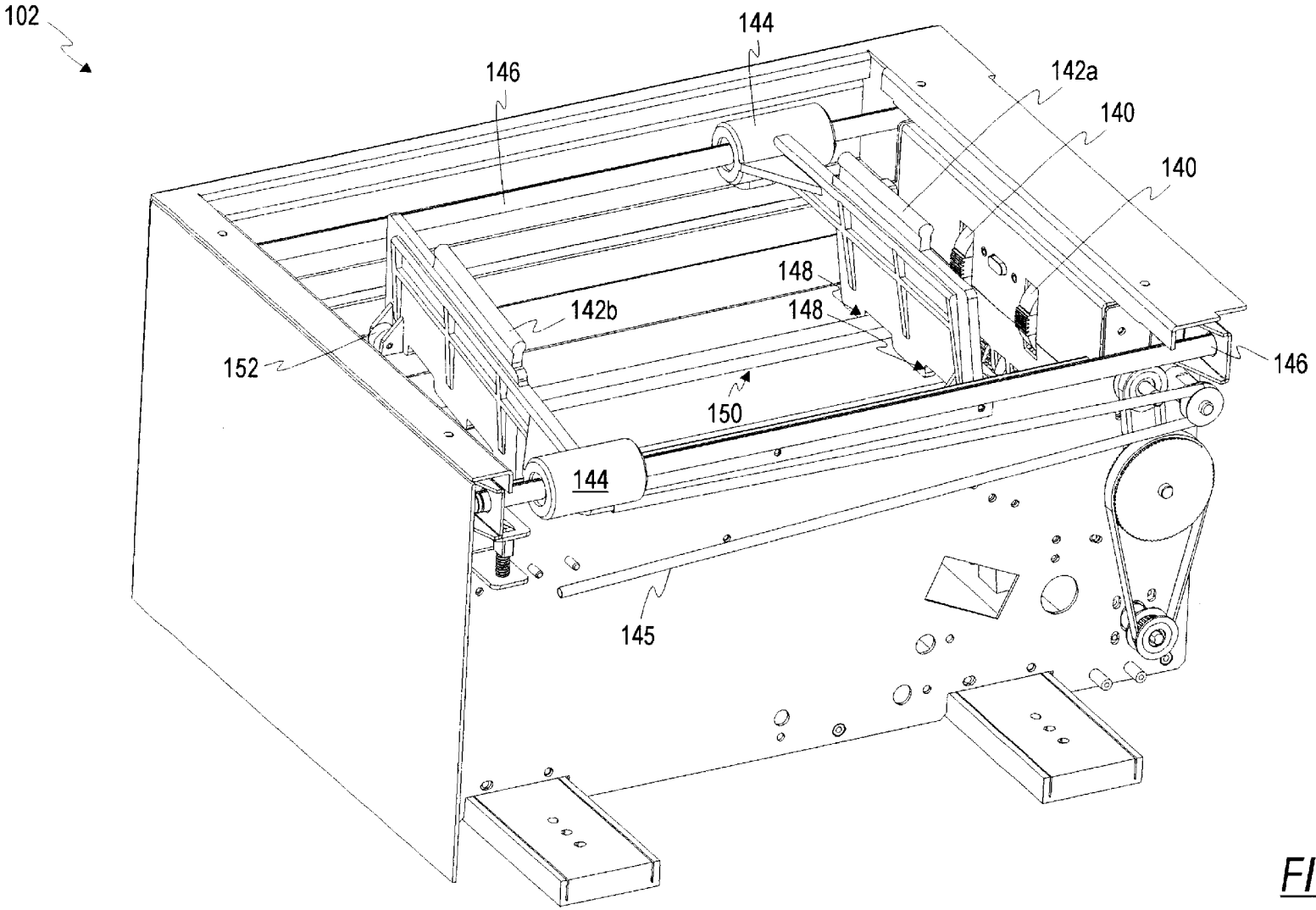
FIG. 3*a* is a perspective view of an input receptacle according to one embodiment of the document handling device of the present invention.
Figure 3B:
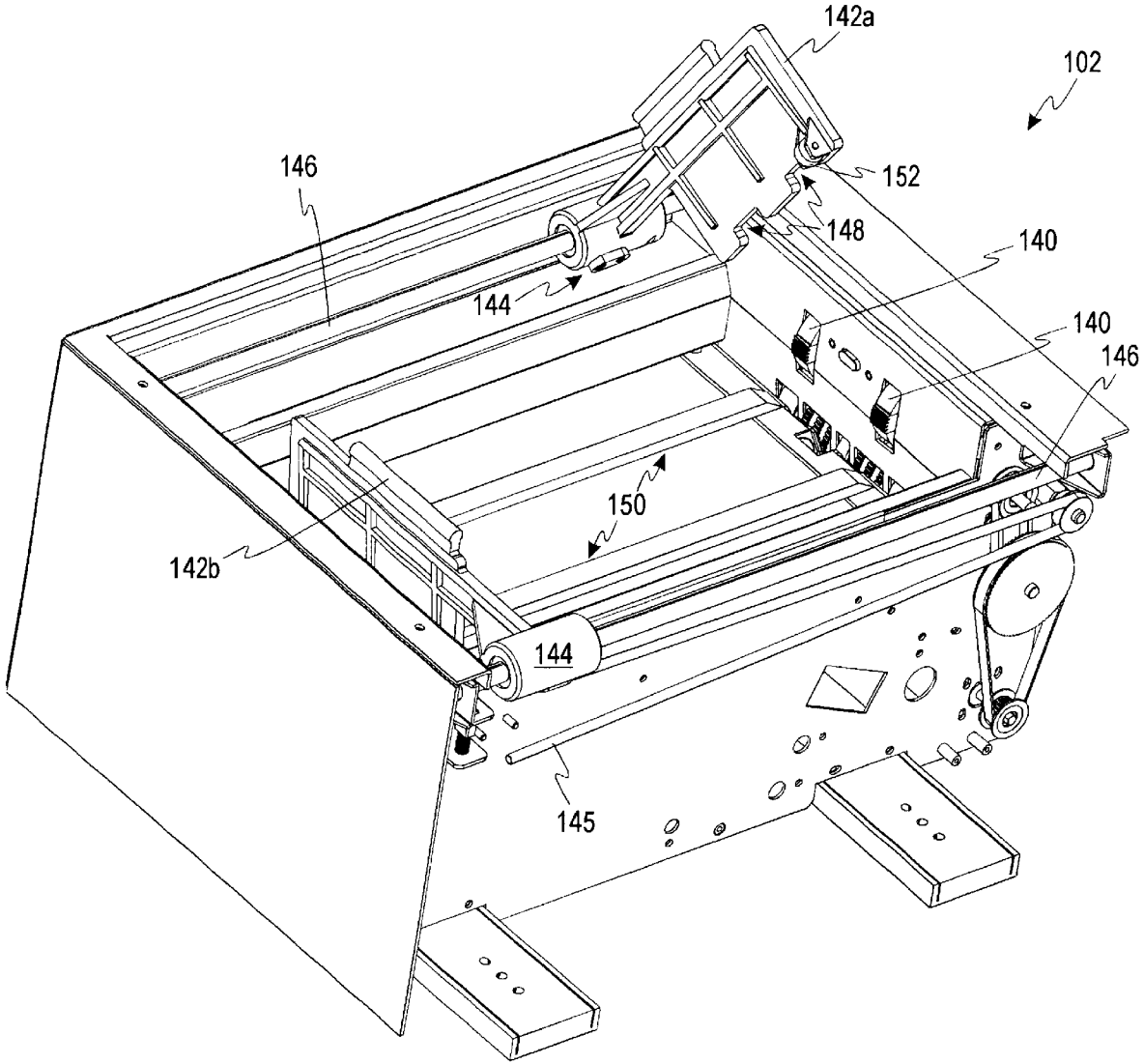
FIG. 3*b* is another perspective view of an input receptacle according to one embodiment of the document handling device of the present invention.
Figure 3C:
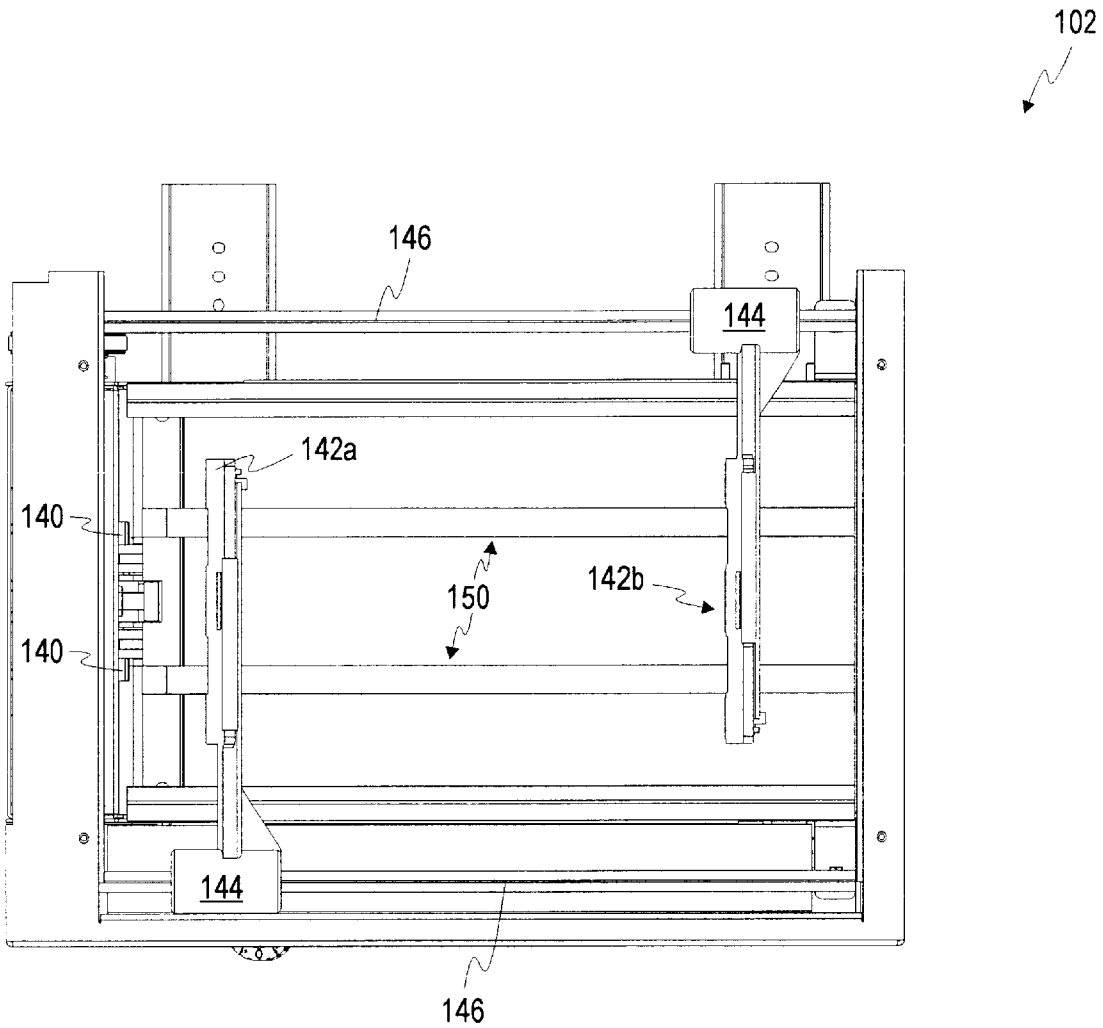
FIG. 3*c* is a top view of an input receptacle according to one embodiment of the document handling device of the present invention.
Figure 3D:
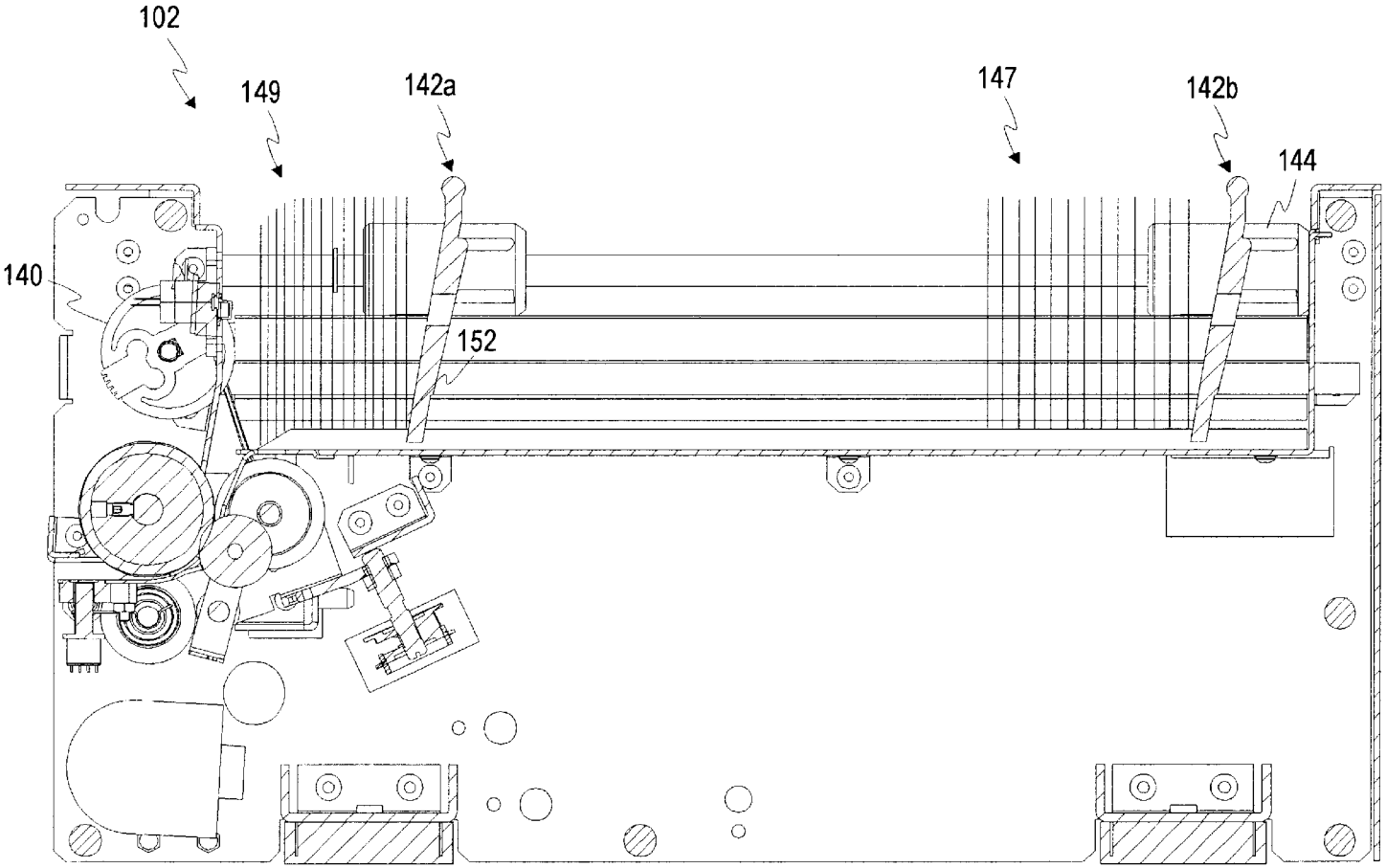
FIG. 3*d* is a side view of an input receptacle according to one embodiment of the document handling device of the present invention.

FIGS. 2*a* and 2*b* illustrate the evaluation region 108 according to one embodiment of the currency handling system 100. The evaluation region can be opened for service, access to sensors, clear bill jams, etc. as shown in FIG. 2*a*. The characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbabilty, transmissivity, electrical conductivity, etc. The evaluation region 108 may employ a variety of detection means including, but not limited to, a size detection and density sensor 408, a lower 410 and an upper 412 optical scan head, a single or multitude of magnetic sensors 414, a thread sensor 416, and an ultraviolet/fluorescent light scan head 418. These detection means and a host of others are disclosed in commonly owned, co-pending U.S. patent application Ser. No. 08/916,100 entitled "Multi-Pocket Currency Discriminator," incorporated by reference above.

The direction of bill travel through the evaluation region 108 is indicated by arrow A. The bills are positively driven along a transport plate 400 through the evaluation region 108 by means of a transport roll arrangement comprising both driven rollers 402 and passive rollers 404. The rollers 402 are driven by a motor (not shown) via a belt 401. Passive rollers 404 are mounted in such a manner as to be free-wheeling about their respective axis and biased into counter-rotating contact with the corresponding driven rollers 402. The driven and passive rollers 402, 404 are mounted so that they are substantially coplanar with the transport plate 400. The transport roll arrangement also includes compressible rollers 406 to aid in maintaining the bills flat against the transport plate 400. Maintaining the bill flat against the transport plate 400 so that the bill lies flat when transported past the sensors enhances the overall reliability of the evaluation processes. A similar transport arrangement is disclosed in commonly-owned U.S. Pat. No. 5,687,963 entitled "Method and Apparatus for Discriminating and Counting Documents," which is incorporated herein by reference in its entirety.

Referring now to FIGS. 3*a*–3*d*, the input receptacle 102 of the currency handling device 100 is illustrated. A feeder mechanism such as a pair of stripping wheels 140 aid in feeding the bills in seriatim to the transport mechanism 104 which first carries the bills through the evaluation region 108. According to one embodiment, the input receptacle 102 includes at least one spring-loaded feeder paddle 142*a* which is pivotally mounted, permitting it to be pivoted upward and drawn back to the rear of a stack of bills placed in the input receptacle 102 so as to bias the bills towards the evaluation region 108 via the pair of stripping wheels 140. The paddle 142*a* is coupled to an advance mechanism 144 to urge the paddle 142*a* towards the stripping wheels 140. In the illustrated embodiment, motion is imparted to the advance mechanism via a spring 145. In other alternative embodiments, the advance mechanism 144 is motor driven. The advance mechanism 144 is slidably mounted to a shaft 146. The advance mechanism 144 also constrains the paddle 142*a* to a linear path. The advance mechanism 144 may contain a liner bearing (not shown) allowing the paddle 142*a* to easily slide along the shaft 146. In the embodiment illustrated, the paddle 142*a* may also contain channels 148 to aid in constraining the paddle 142*a* to a linear path along a pair of tracks 150. The paddle 142*a* may additionally include a roller 152 to facilitate the movement of the paddle 142*a*.

In the embodiment illustrated in FIGS. 3*a*–3*d*, a second paddle 142*b* is provided such that a second stack of bills 147 may be placed in the input receptacle 102 behind a first group of bills 149, while the first group of bills 149 is being fed into the currency handling device 100. Thus, the two feeder paddles 142*a* and 142*b* may be alternated during processing in order to permit multiple stacks of currency bills to be loaded into the input receptacle 102. In such an embodiment, the operator would retract paddle 142*a* and place a stack of bills into the input receptacle. Once inside the input receptacle, the operator would place the paddle 142*a* against the stack of bills so that the paddle 142*a* biases the stack of bills towards the pair of stripper wheels 140. The operator could then load a second stack of bills into the input receptacle 102 by retracting the second paddle 142*b* and placing a stack of bills in the input receptacle between the paddles 142*a* and 142*b*. The second paddle 142*b* urges the second stack of bills up against the backside of the first paddle 142*a*. The operator can then upwardly rotate the first paddle 142*a* thus combining the two stacks. The first paddle

142*a* is then retracted to the rear of the input receptacle and the process can be repeated. The two paddle input receptacle allows the operator to more easily continuously feed stacks of bills to the currency handling device 100. In devices not having two feeder paddles, the operator is forced to awkwardly manipulate the two stacks of bills and the advance mechanism. Alternatively, the operator may wait for the stack of bills to be processed out of the input receptacle to add another stack; however, waiting to reload until each stack is processed adds to the total time to process a given amount of currency.

Figure 4:
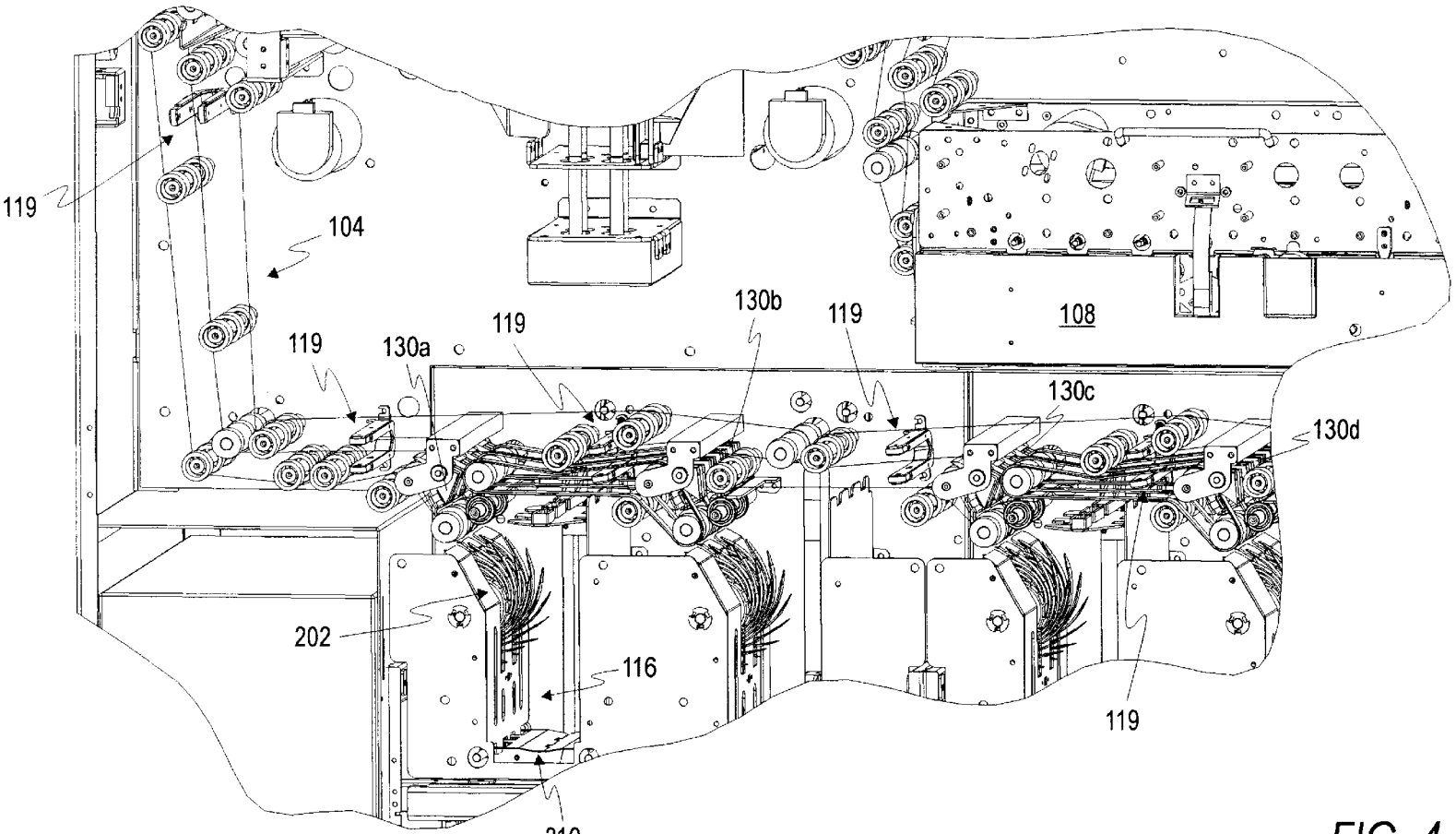
FIG. 4 is a perspective view of a portion of a transportation mechanism according to one embodiment of the present invention.

Referring to FIG. 4, a portion of the transport mechanism 104 and diverters 130*a*–130*d* are illustrated. A substantial portion of the transport path of the currency handling device 100 positively grips the bills during transport from the pair of stripping wheels 140 through the point where bills are delivered to upper output receptacle 106*a* or are delivered to the stacker wheels 202 of output receptacles 106*b*–106*h*. The positive grip transport path of the currency handling device 100 is less costly and weighs less than the vacuum transport arrangements of prior currency processing devices.

The transport mechanism 104 is electronically geared causing all sections to move synchronously from the evaluation region 108 through the point where the bills are delivered to the output receptacles 106. Multiple small motors are used to drive the transport mechanism 104. Using multiple small, less costly motors is more efficient and less costly than a single large motor. Further, less space is consumed enabling the currency handling device 100 to be more compact. Electronically gearing the transport mechanism 104 enables a single encoder to monitor bill transportation within the currency handling system 100. The encoder is linked to the bill transport mechanism 104 and provides input to a processor to determine the timing of the operations of the currency handling device 100. In this manner, the processor is able to monitor the precise location of the bills as they are transported through the currency handling device 100. This process is termed "flow control." Input from additional sensors 119 located along the transport mechanism 104 of the currency handling device 100 enables the processor to continually update the position of a bill within the device 100 to accommodate for bill slippage. When a bill leaves the evaluation region 108 the processor expects the bill to arrive at the diverter 130*a* corresponding to the first lower output receptacle 106*c* after a precise number of encoder counts. Specifically, the processor expects the bill to flow past each sensor 119 positioned along the transport mechanism 104 at a precise number of encoder counts. If the bill slips during transport but passes a sensor 119 later within an acceptable number of encoder counts the processor updates or "re-queues" the new bill position. The processor calculates a new figure for the time the bill is expected to pass the next sensor 119 and arrive at the first diverter 130*a*. The processor activates a the one of the diverters 130*a*–*f* to direct the bill into the appropriate corresponding lower output receptacle 106*c*–106*h* when the sensor 119 immediately preceding the diverter 130 detects the passage of the bill to be directed into the appropriate lower output receptacle 106*c*–*h*.

The currency handling device 100 also uses flow control to detect jams within the transport mechanism 104 of the device 100. When a bill does not reach a sensor 119 within in the calculated number of encoder counts plus the maximum number of counts allowable for slippage, the processor suspends operation of the device 100 and informs the operator via the display/user-interface 122 that a jam has occurred. The processor also notifies the operator via the display/user-interface 122 of the location of the jam by indicating the last sensor 119 that the bill passed and generally the approximate location of the jam in the system. If the operator cannot easily remove the bill without damage, the operator can then electronically jog the transport path in the forward or reverse direction via the control unit 120 so that the jammed bill is dislodged and the operator can easily remove the bill from the transport path. The operator can then flush the system causing the transport mechanism 104 to deliver all of the bills currently within the transport path of the currency handling device 100 to one of the output receptacles 106. In an alternative embodiment, the user of the currency handling device 100 would have the option when flushing the system to first have the bills already within the escrow regions 116*a*–116*f* to be delivered to the respective lower storage cassettes 106*c*–106*h* so that those bills may be included in the aggregate value data for the bills being processed. The bills remaining in the transport path 104 would then be delivered to a predetermined escrow region 116 where those bills could be removed and reprocessed by placing those bills in the input receptacle 102.

Utilizing flow control to detect jams is more desirable than prior art currency evaluation machines which do not detect a jam until a sensor is actually physically blocked. The latter method of jam detection permits bills to pile up while waiting for a sensor to become blocked. Bill pile-up is problematic because it may physically halt the machine before the jam is detected and may cause physical damage to the bills and the machine. In order to remedy a jam in a prior art machine, the operator must first manually physically dislodge the jammed bills. The operator must then manually turn a hand crank which advances the transport path until all bills within the transport path are removed. Moreover, because the prior art devices permit multiple bills to pile up before a jam is detected, the integrity of the process is often ruined. In such a case, the entire stack of bills must be reprocessed.

Referring back to FIG. 1*a*, the illustrated embodiment of the currency handling device 100 includes a total of six lower output receptacles 106*c*–106*h*. More specifically, each of the lower output receptacles 106*c*–106*h* includes a first portion designated as an escrow compartment 116*a*–116*f* and a second portion designated as a storage cassette 118*a*–118*f*. Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*–106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise two lower output receptacles. In other alternative embodiments, several modular units may be added at one time to the currency handling device 100.

A series of diverters 130*a*–130*f*, which are a part of the transportation mechanism 104, direct the bills to one of the lower output receptacles 106*c*–106*h*. When the diverters 130 are in an upper position, the bills are directed to the adjacent lower output receptacle 106. When the diverters 130 are in a lower position, the bills proceed in the direction of the next diverter 130.

Figure 5:
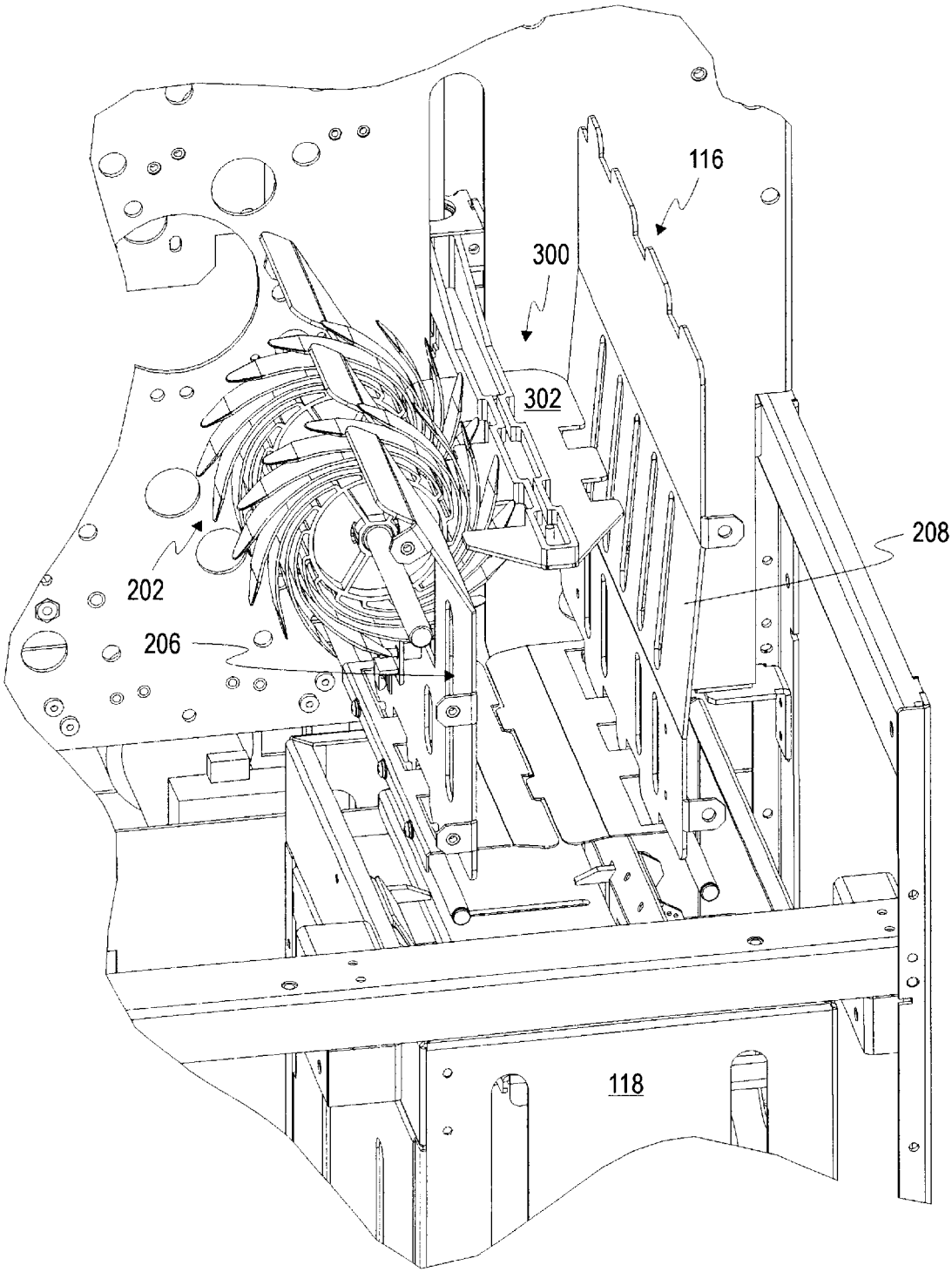
FIG. 5 is a front perspective view of an escrow compartment, a plunger assembly, and a storage cassette according to one embodiment of the document handling device of the present invention.

The vertical arrangement of the lower output receptacles 106*c*–106*h* is illustrated in FIG. 5. The escrow compartment 116 is positioned above the storage cassette 118. In addition to the escrow compartment 116 and the storage cassette 118, each of the lower output receptacles 106*c*–106*h* contains a plunger assembly 300. The plunger assembly 300 is shown during its decent towards the storage cassette 118.

Figure 6:
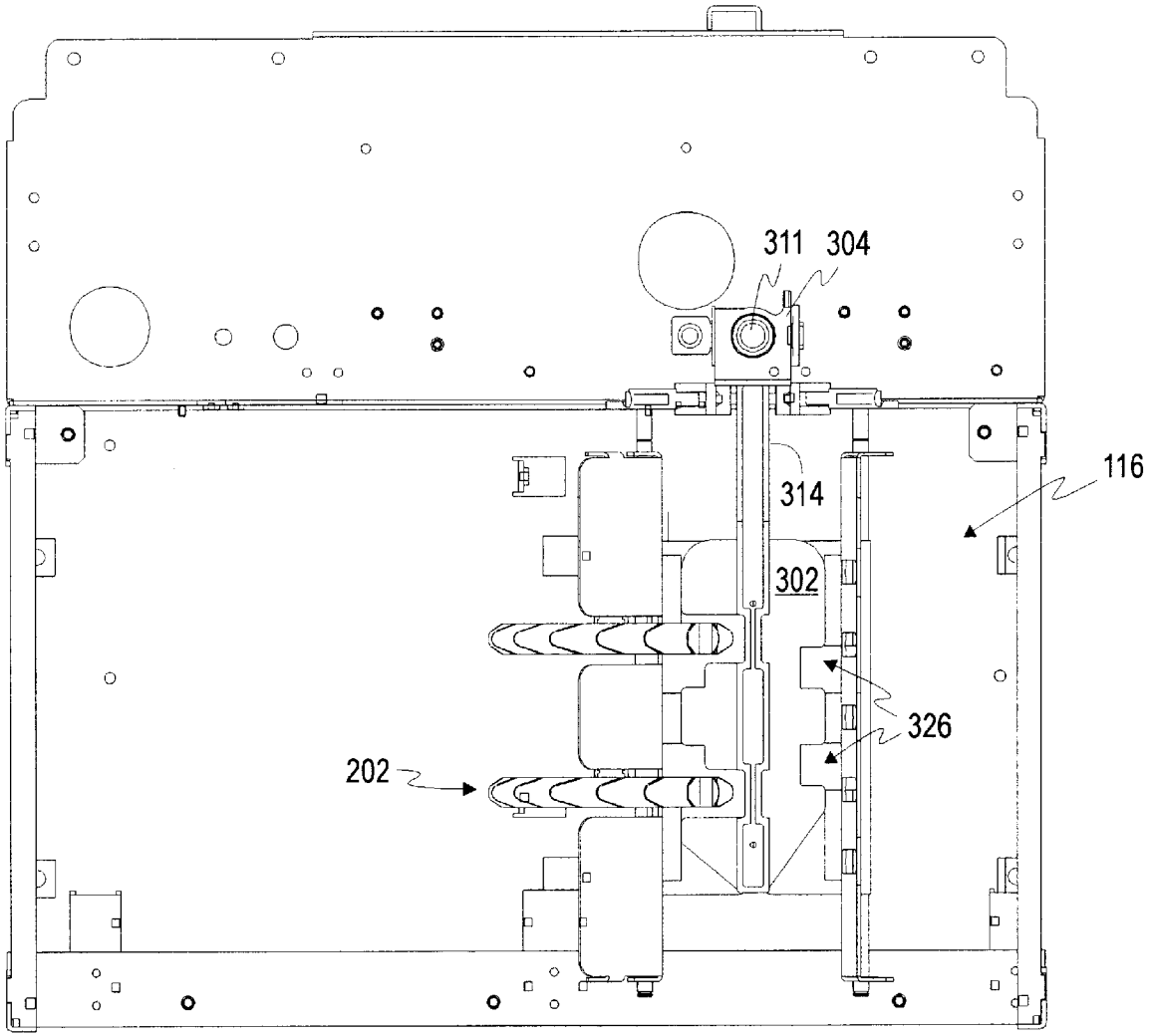
FIG. 6 is a top view of an escrow compartment and plunger assembly according to one embodiment of the document handling device of the present invention.
Figure 7:
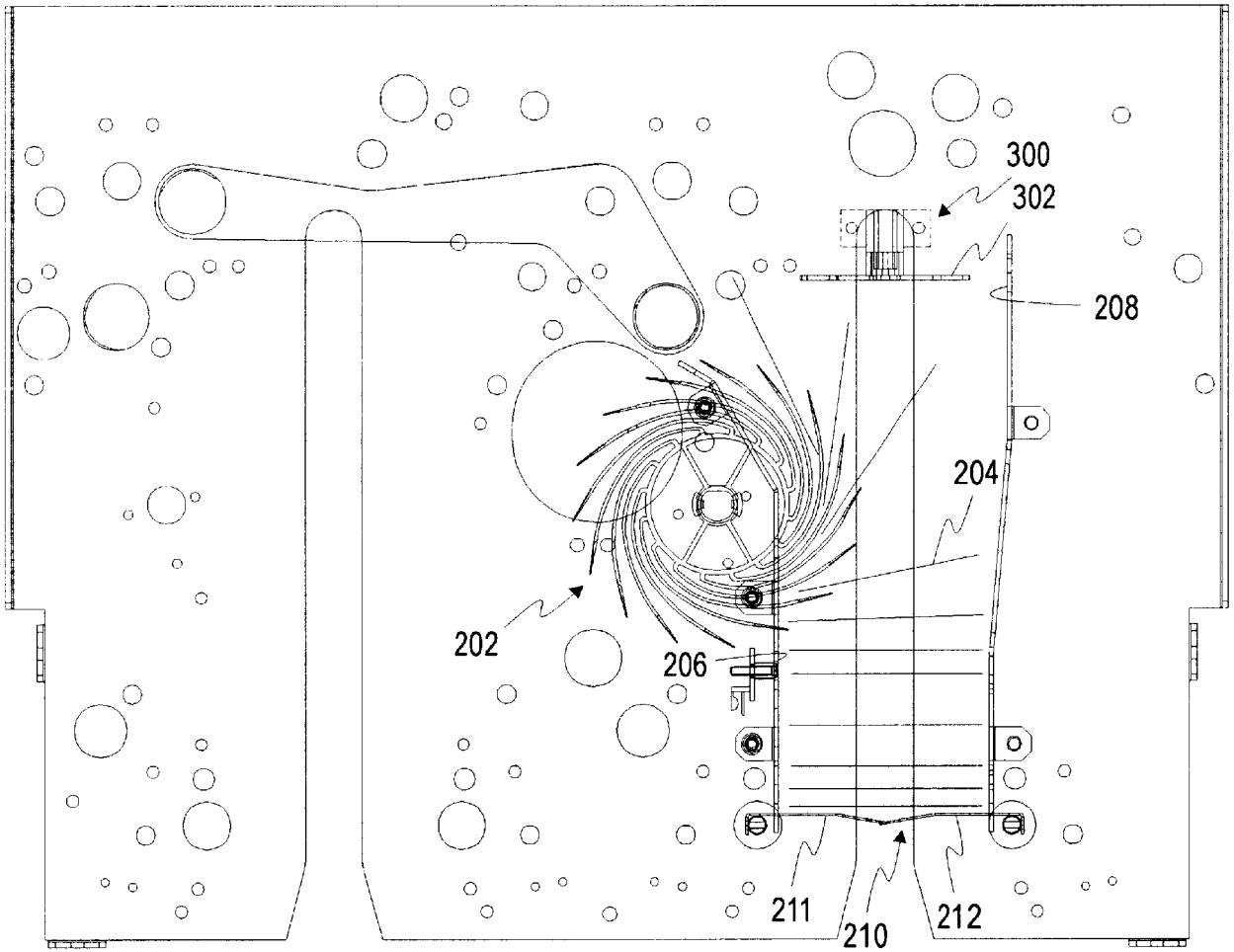
FIG. 7 is a front view of an escrow compartment and plunger assembly according to one embodiment of the document handling device of the present invention.

Referring now to FIGS. 6 and 7, one of the escrow compartments 116 of the lower output receptacles 106*c*–106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. Below the gate 210 is the storage cassette 118 (not shown in FIGS. 6 and 7).

Figure 8:
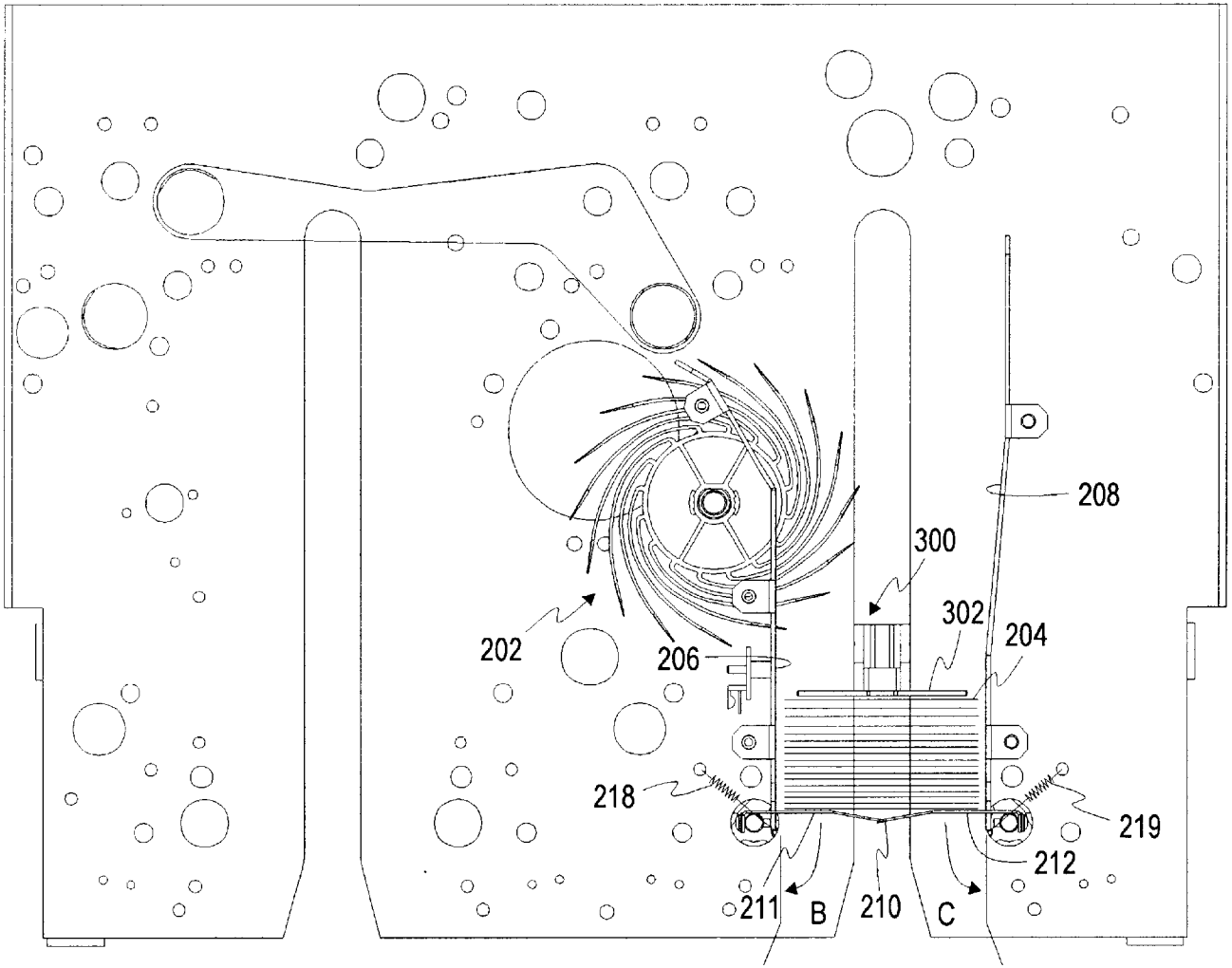
FIG. 8 is another front view of an escrow compartment and plunger assembly according to one embodiment of the document handling device of the present invention.

FIG. 8 illustrates the positioning of the paddle 302 when transferring a stack of bills from the escrow compartment 116 to the storage cassette 118. When the paddle descends upon the stack of bills 204 it causes shutters 211, 212 to quickly rotate in the directions referred to by arrows B and C, respectively, thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Figure 9:
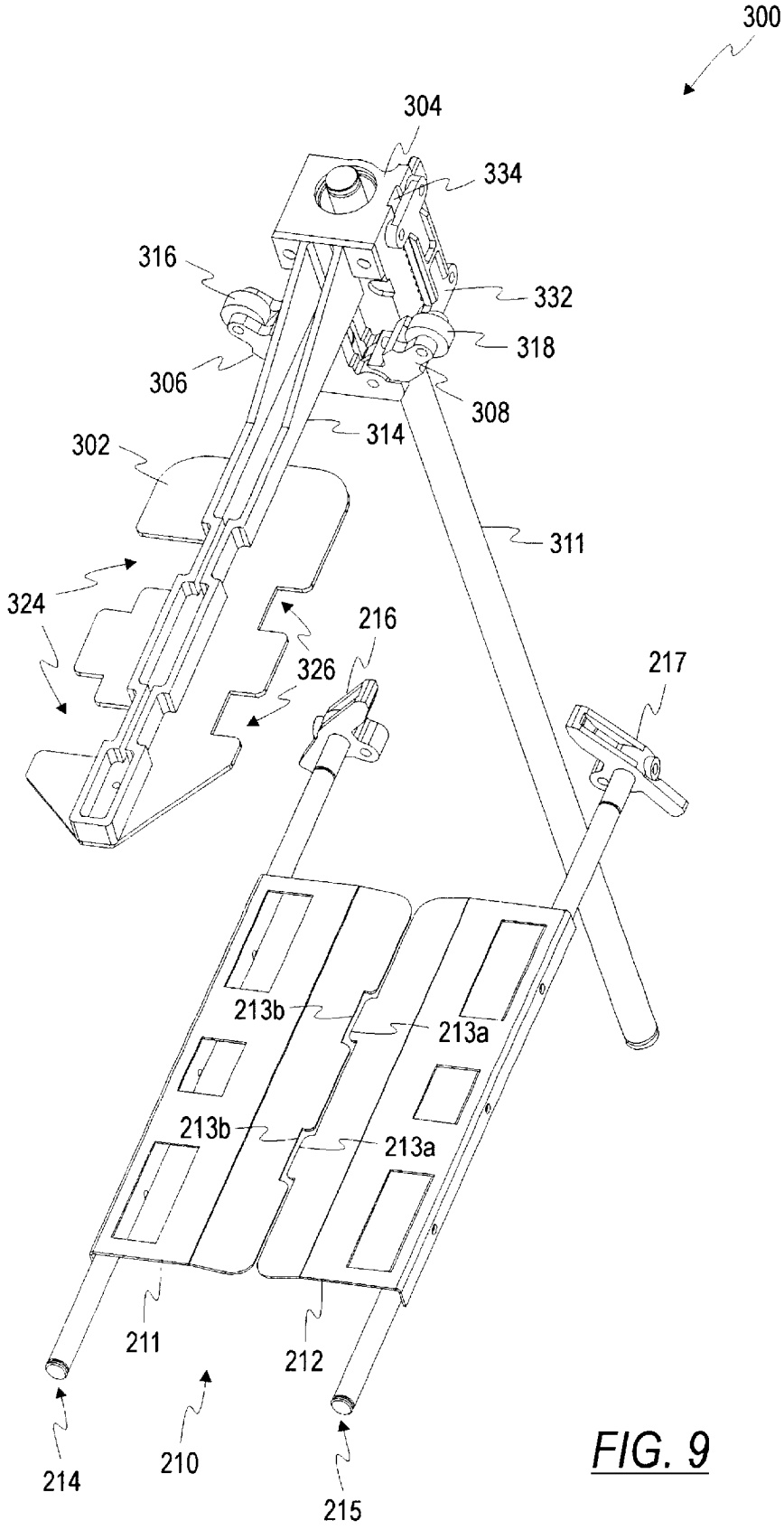
FIG. 9 is a perspective view of an apparatus for transferring currency from an escrow compartment to a storage cassette according to one embodiment of the document handling device of the present invention.

Referring now to FIG. 9, the plunger assembly 300 for selectively transferring the bills 204 from an escrow compartment 116 to a corresponding storage cassette 118 and the gate 210 are illustrated in more detail. One such plunger assembly 300 is provided for each of the six lower output receptacles 106*c*–106*h* of the currency handling device 100. The plunger assembly 300 comprises a paddle 302, a base 304, and two side arms 306, 308. Each of the shutters 211, 212 comprising the gate 210 extend inwardly from corresponding parallel bars 214, 215. The bars 214, 215 are mounted for pivoting the shutters between the closed position and the open position. Levers 216, 217 are coupled to the parallel bars 214, 215, respectively, to control the rotation of the bars 214, 215 and hence of the shutters 211, 212. Extension springs 218, 219 (shown in FIG. 8) tend to maintain the position of the levers 216, 217 both in the closed and open positions. The shutters 211, 212 have an integral tongue 213*a* and groove 213*b* arrangement which prevents any bills which are stacked upon the gate 210 from slipping between the shutters 211, 212.

The base 304 travels along a vertical shaft 311 with which it is slidably engaged. The base 304 may include linear bearings (not shown) to facilitate its movement along the vertical shaft 311. The plunger assembly 300 may also include a vertical guiding member 312 (see FIG. 11) with which the base 304 is also slidably engaged. The vertical guiding member 312 maintains the alignment of the plunger assembly 300 by preventing the plunger assembly 300 from twisting laterally about the vertical shaft 311 when the paddle 302 forces the bills 204 stacked in the escrow area 116 down into a storage cassette 118.

Figure 10:
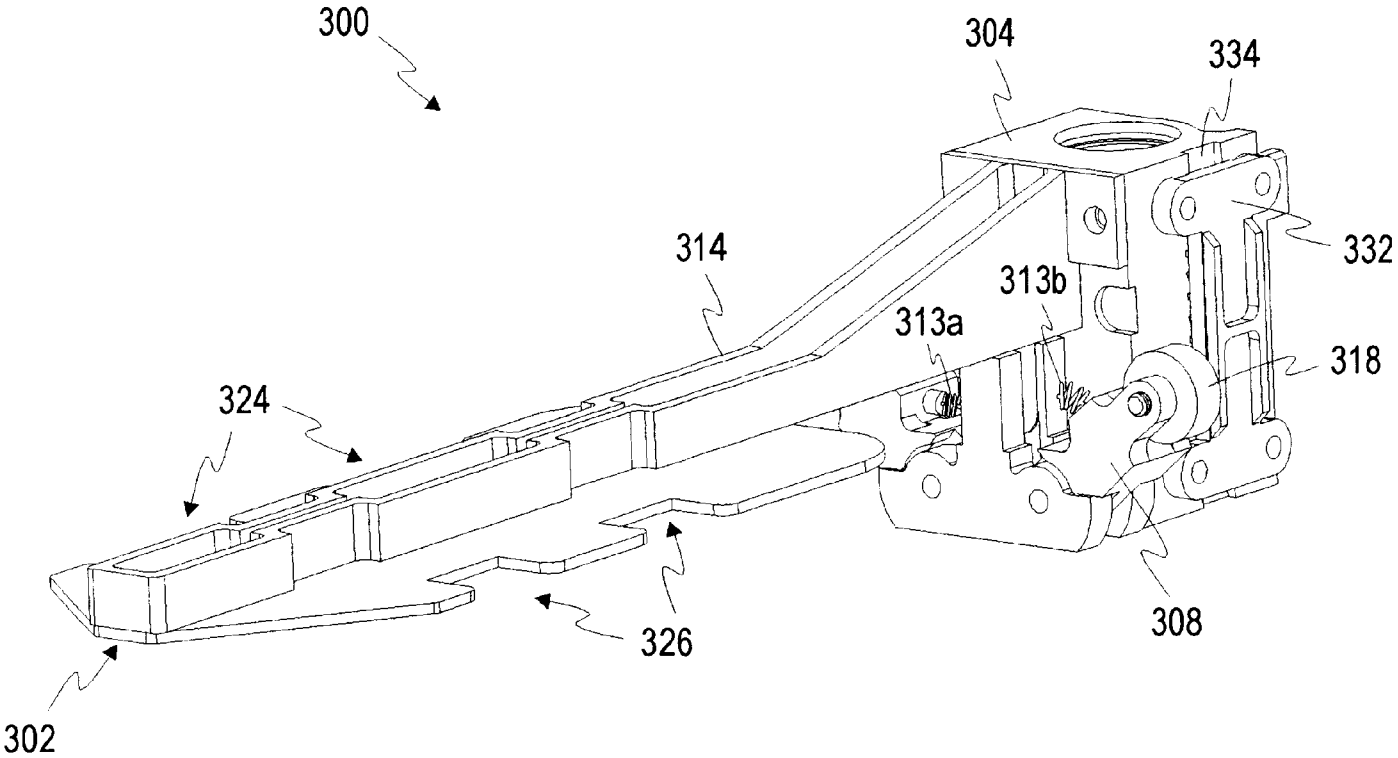
FIG. 10 is a perspective view of a paddle according to one embodiment of the document handling device of the present invention.

Referring also to FIG. 10, the paddle 302 extends laterally from the base 304. The paddle 302 is secured to a support 314 extending from the base 304. A pair of side arms 306, 308 are hingedly connected to the base. Each of the side arms 306, 308 protrude from the sides of the base 304. Rollers 316, 318 are attached to the side arms 306, 308, respectively, and are free rolling. Springs 313*a*, 313*b* are attached to the side arms 306, 308, respectively, to bias the side arms 306, 308 outward from the base 304. In the illustrated embodiment, the spring 313*a*, 313*b* are compression springs.

The paddle 302 contains a first pair of slots 324 to allow the paddle to clear the stacker wheel 202 when descending into and ascending out of the cassette 118. The first pair of slots 324 also enables the paddle 302 to clear the first pair of retaining tabs 350 within the storage cassette (see FIG. 14). Similarly, paddle 302 contains a second pair of slots 326 to enable the paddle 302 to clear the second pair of retaining tabs 350 within the storage cassette 118 (see FIG. 14).

Figure 11:
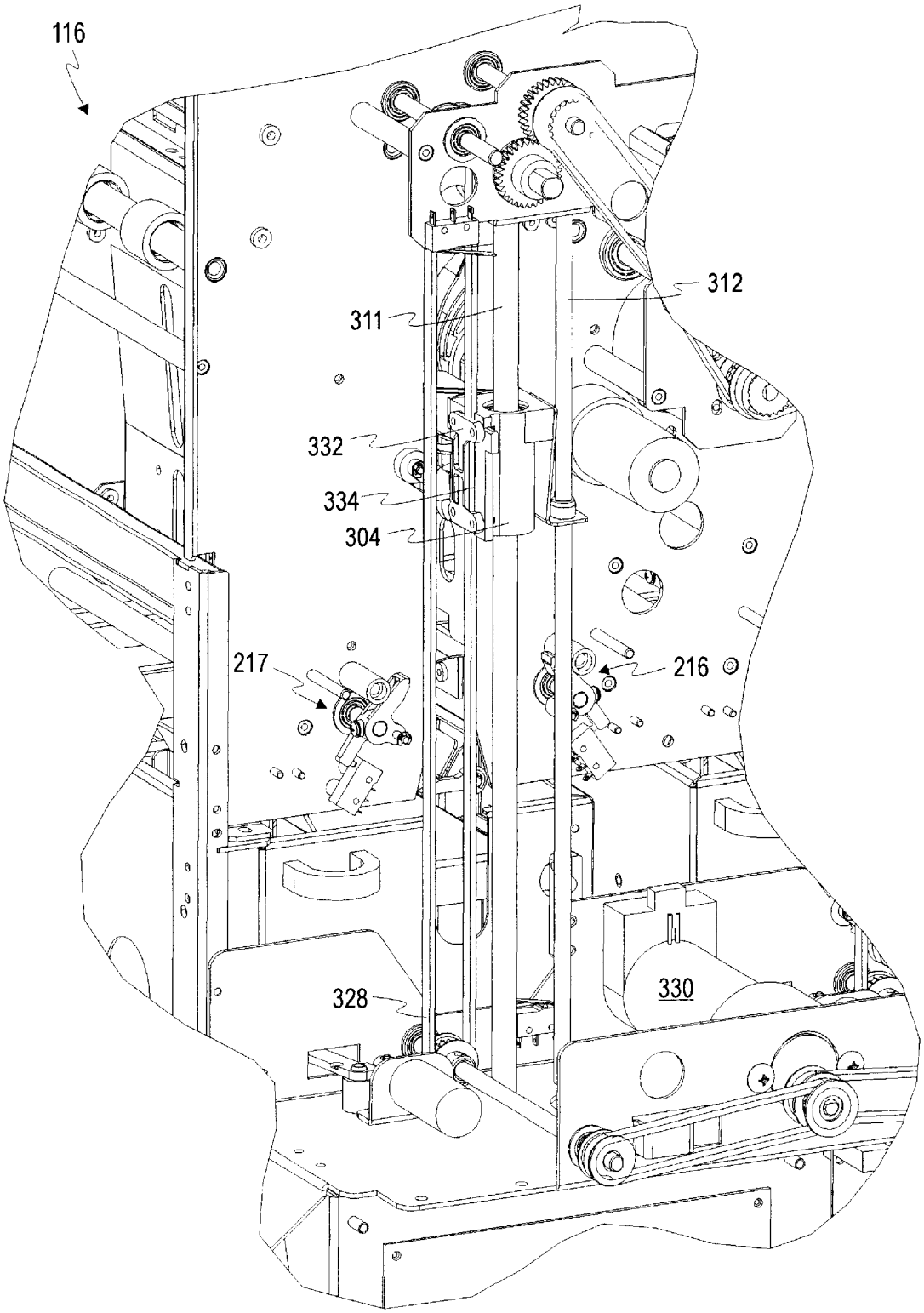
FIG. 11 is a rear perspective view of the escrow compartment, plunger assembly, and storage cassette according to one embodiment of the document handling device of the present invention.

Referring now to FIG. 11, which illustrates a rear view of one of the lower output receptacles 106*c*–106*h*, the plunger 300 is bidirectionally driven by way of a belt 328 coupled to an electric motor 330. A clamp 332 engages the belt 328 into a channel 334 in the base 304 of the plunger assembly 300. In the embodiment illustrated in FIG. 11, two plunger assemblies 300 are driven by a single electric motor 330. In one embodiment of the currency handling device, the belt 328 is a timing belt. In other alternative embodiments, each plunger assembly 300 can be driven by a single electric motor 330. In still other alternative embodiments, there can be any combination of motors 330 to plunger assemblies 300.

Figure 12:
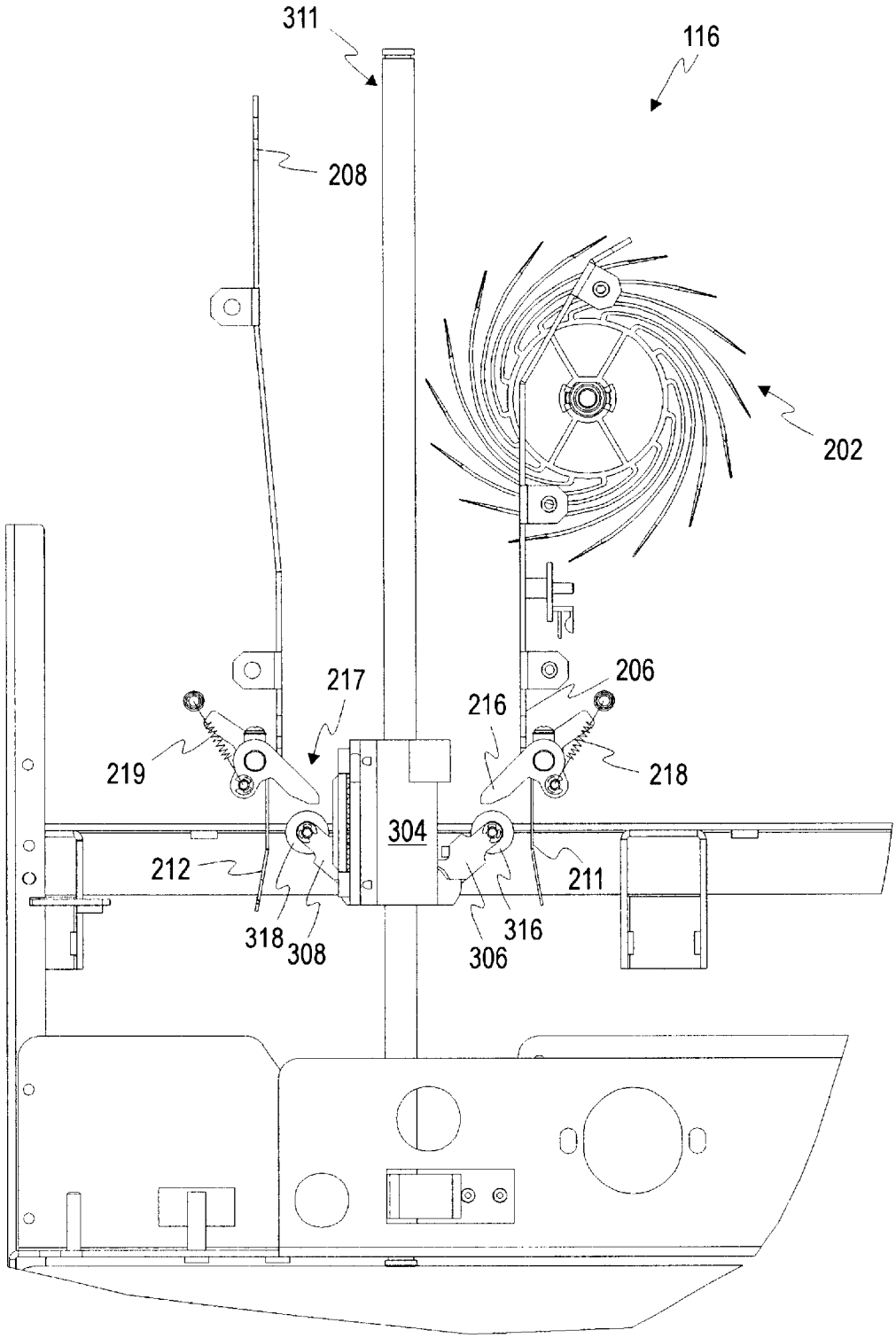
FIG. 12 is a rear view of a plunger assembly wherein the gate is in the open position according to one embodiment of the document handling device of the present invention.
Figure 13:
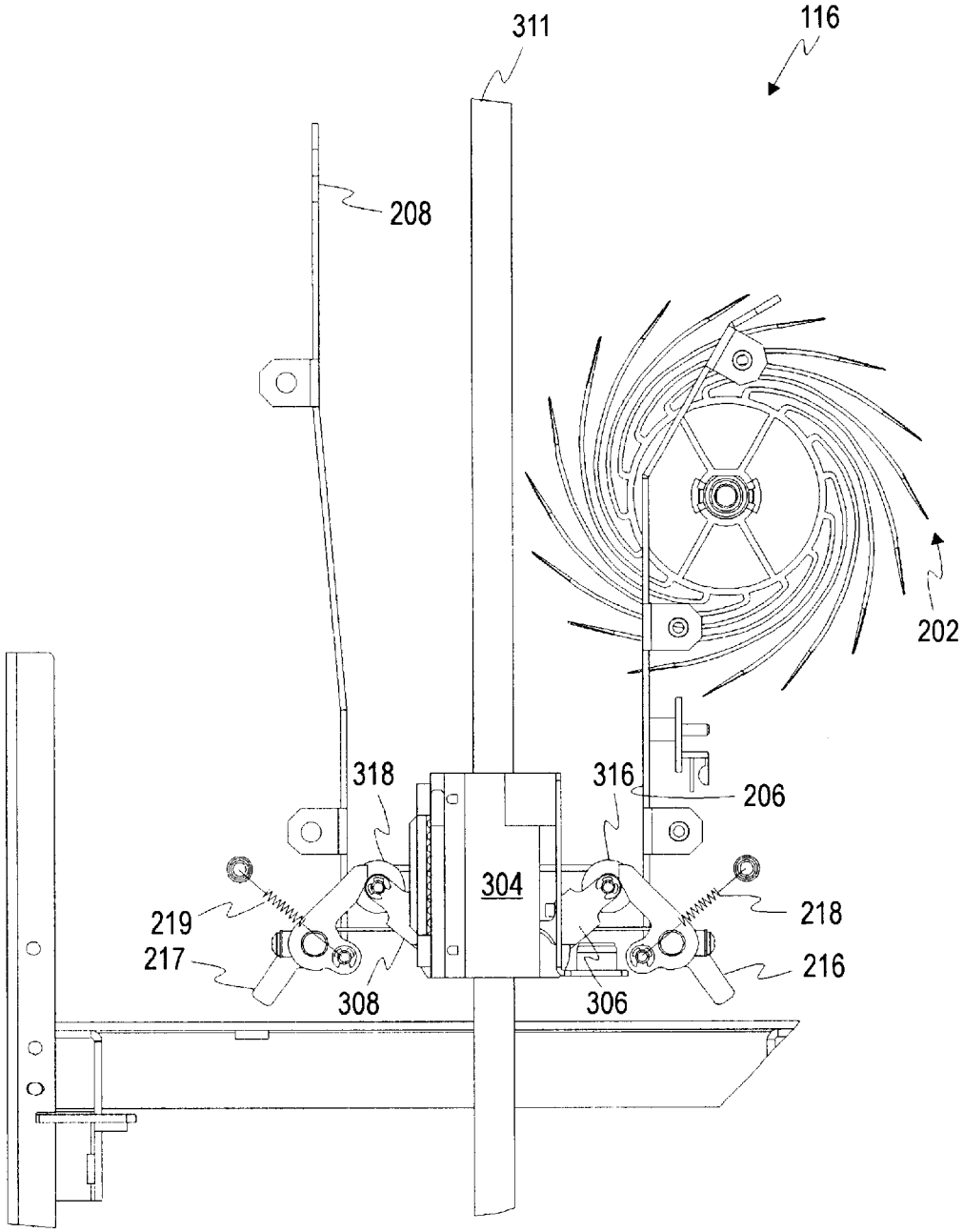
FIG. 13 is a rear view of a plunger assembly wherein the gate is in the closed position according to one embodiment of the document handling device of the present invention.

FIGS. 12 and 13 illustrate the interaction between the side arms 306, 308 and the levers 216, 217 when the paddle assembly 300 is descending towards and ascending away from the storage cassette 118, respectively. Initially, before descending towards the cassette, the shutters are in a first (closed) position. In the illustrated embodiment, it is the force imparted by the paddle 302 which opens the gate 210 when the paddle descends towards the storage cassette 118. When the paddle is ascending away from the storage cassette 119, it is the rollers 316, 318 coupled to the side arms 306, 308 which engage the levers 216, 217 that close the gate 210. The levers 216, 217 shown in FIG. 12 are positioned in the open position. When descending towards the storage cassette 118, the rollers 316, 318 contact the levers 216, 217 and roll around the levers 216, 217 leaving the shutters in the open position. The side arms 306, 308 are hinged in a manner which allows the side arms 306, 308 to rotate inward towards the base 304 as the rollers 316, 318 engage the levers 216, 217. FIG. 13 illustrates the levers in the second position wherein the gate 210 is closed. When the paddle ascends out of the storage cassette, the side arms 306, 308 are biased away from the base 304. The rollers 316, 318 engage the levers 216, 217 causing the levers to rotate upward to the first position thus closing the gate.

Figure 14:
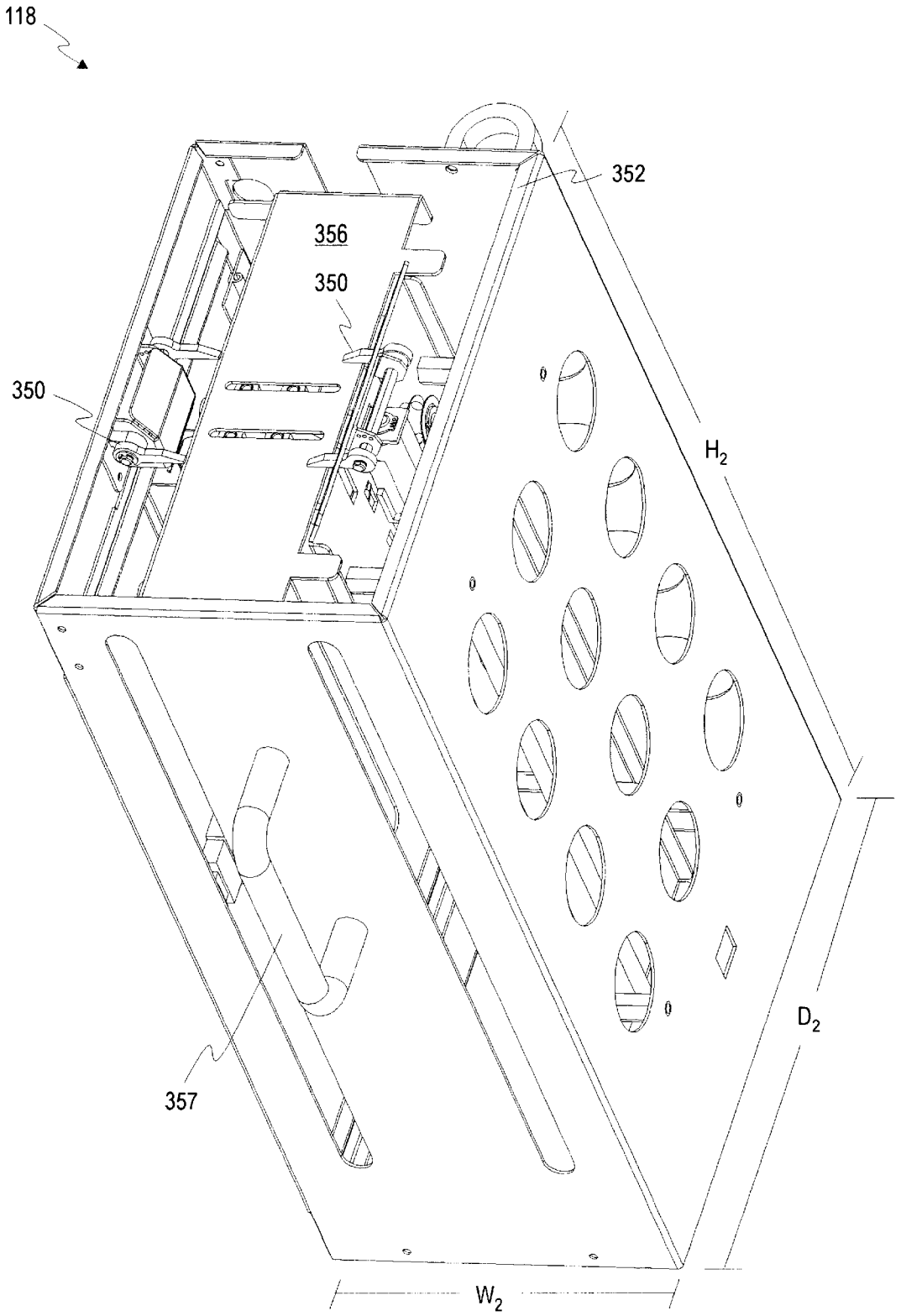
FIG. 14 is a perspective view of a storage cassette according to one embodiment of the document handling device of the present invention.
Figure 15:
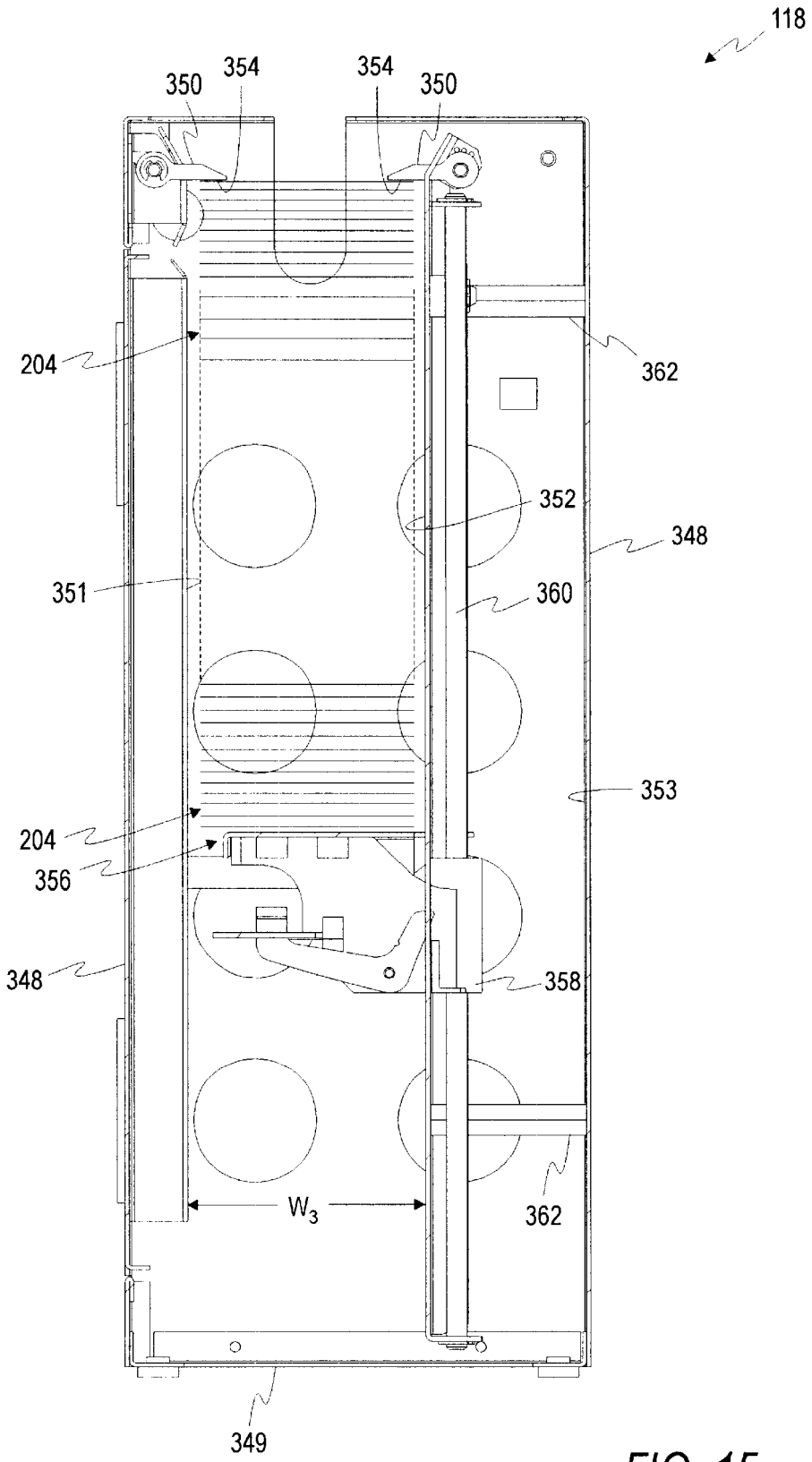
FIG. 15 is a rear view of a storage cassette according to one embodiment of the document handling device of the present invention.
Figure 16:
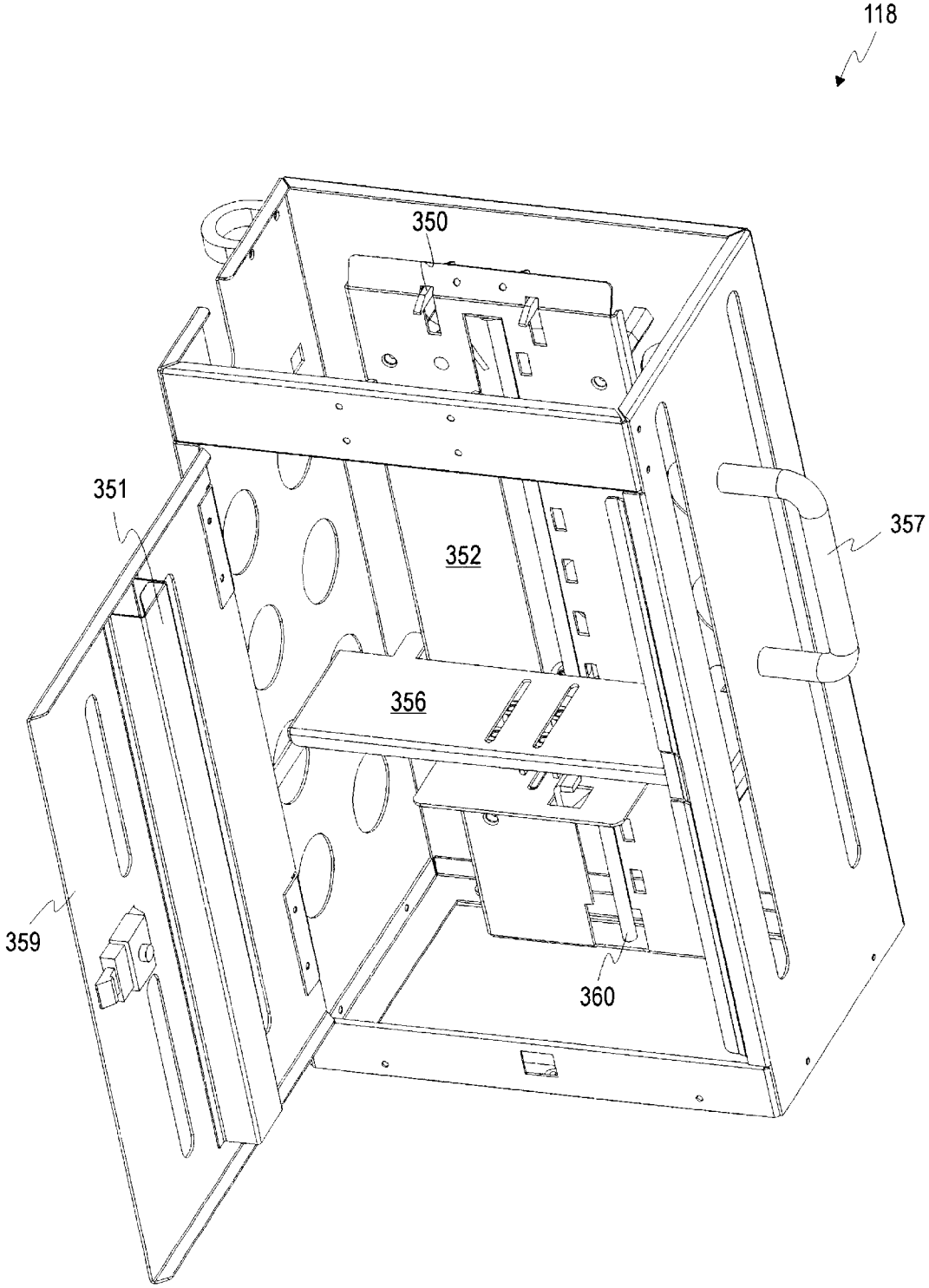
FIG. 16 is a perspective view of a storage cassette where the door is open according to one embodiment of the document handling device of the present invention.

FIGS. 14, 15, and 16 illustrate the components of the storage cassettes 118. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. The storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118

Figure 17A:
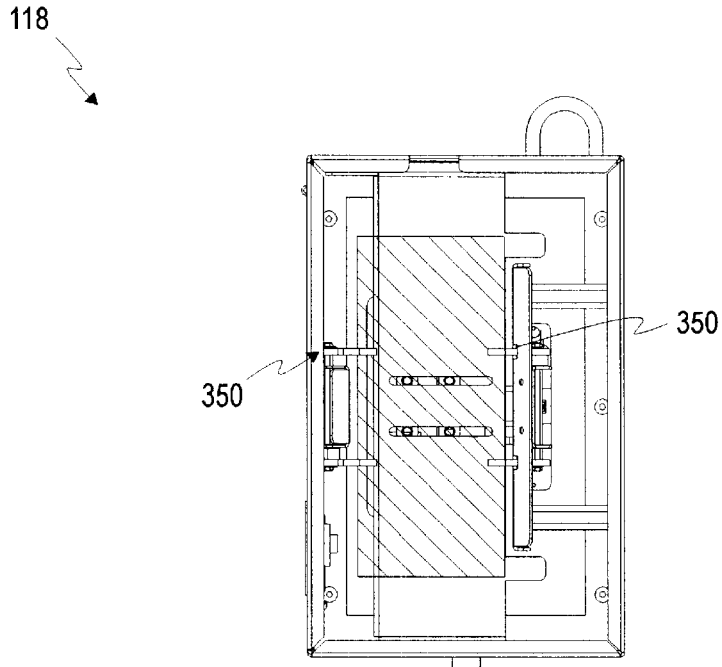
FIG. 17*a* is a top view of a storage cassette sized to accommodate United States currency documents according to one embodiment of the document handling device of the present invention.
Figure 17B:
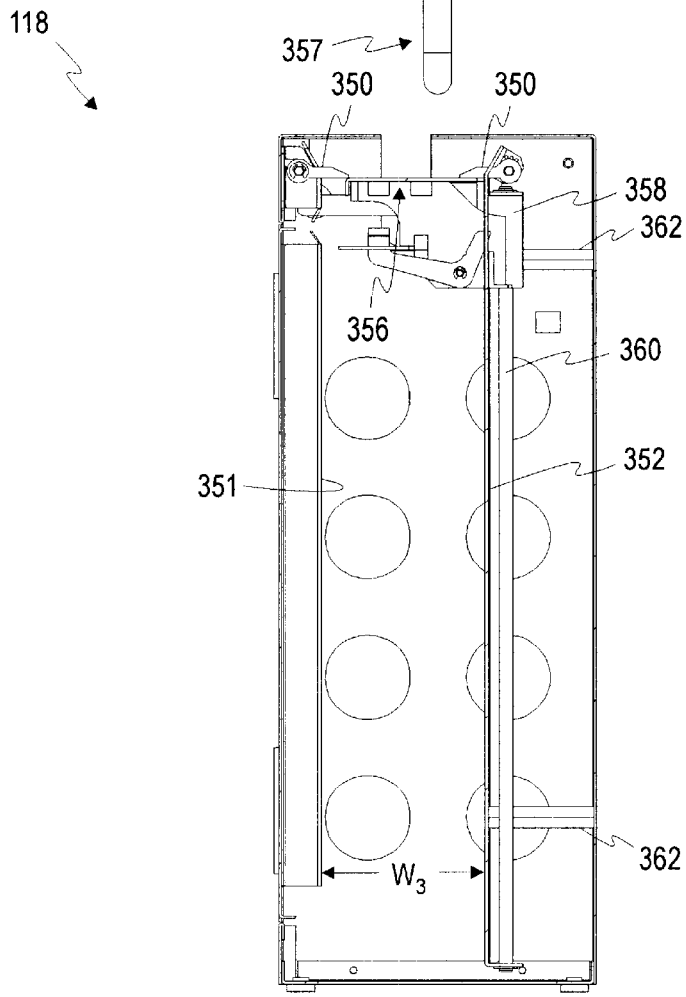
FIG. 17*b* is a rear view of a storage cassette sized to accommodate United States currency documents according to one embodiment of the document handling device of the present invention.
Figure 18A:
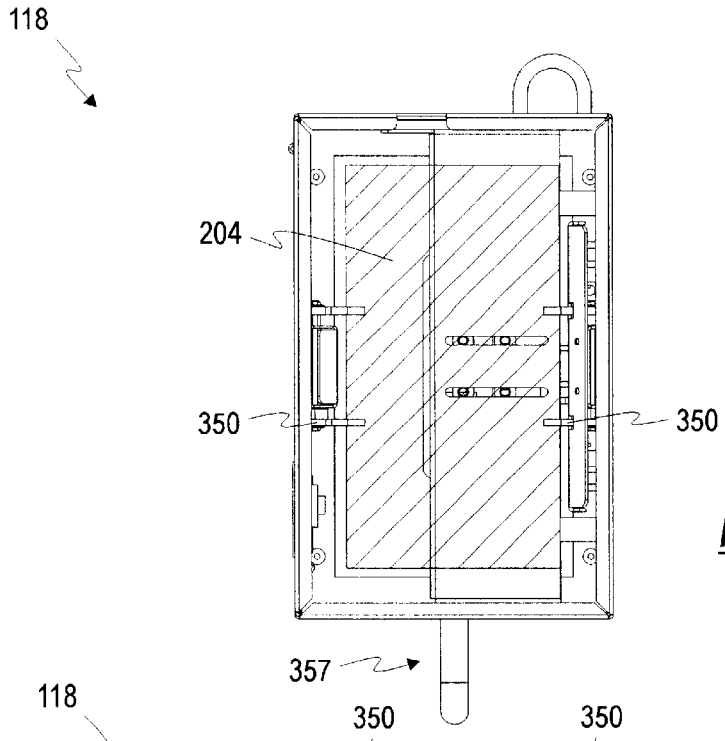
FIG. 18*a* is a top view of a storage cassette sized to accommodate large documents according to one embodiment of the document handling device of the present invention.
Figure 18B:
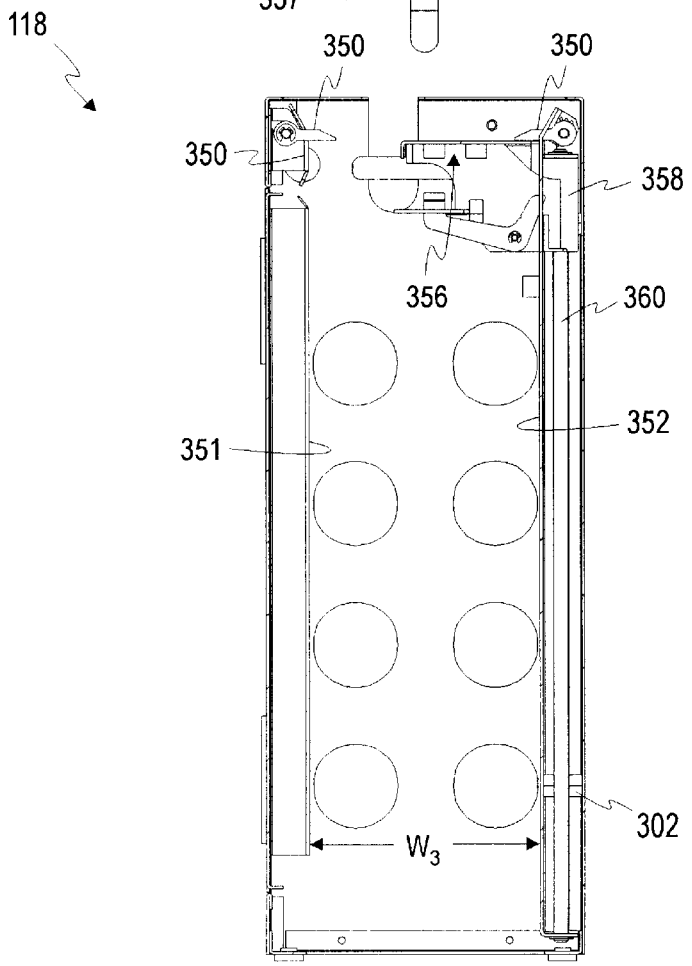
FIG. 18*b* is a rear view of a storage cassette sized to accommodate large documents according to one embodiment of the document handling device of the present invention.

The storage cassettes 118 are dimensioned to accommodate documents of varying sizes. In the illustrated embodiment, the storage cassettes 118 has a height, $H_2$, of approximately 15.38 inches (39 cm), a depth, $D_2$, of approximately 9 inches (22.9 cm), and a width, $W_2$, of approximately 5.66 inches (14.4 cm). The storage cassette illustrated in FIG. 15 has stand-offs 362 to set interior wall 352 off a fixed distance from in the interior wall 353 of the cassette housing 348. The interior walls 351, 352 aid in aligning the bills in a stack within the storage cassettes. The embodiment of the storage cassette illustrate in FIG. 15 is sized to accommodate United States currency documents. To properly accommodate United States currency documents, the interior width of the storage cassette, $W_3$, is approximately 2.88 inches. FIGS. 17*a* and 17*b* also illustrate an embodiment of the storage cassette 118 sized to accommodate U.S. currency documents which have a width of approximately 2.5 inches (approximately 6.5 cm) and a length of approximately 6 inches (approximately 15.5 cm). In alternative embodiments, the length of the stand-offs 362 can be varied to accommodate documents of varying sizes. For example, the embodiment disclosed in FIGS. 18*a* and 18*b* has an interior width, $W_3$ of approximately 4.12 inches (104.6 cm) and is sized to accommodate the largest international currency, the French 500 Franc note, which has width of approximately 3.82 inches (9.7 cm) and a length of approximately 7.17 inches (18.2 cm). In order to accommodate large documents and increase the interior width, $W_3$, of the storage cassette 118, the lengths of stand-offs 362, illustrated in FIG. 16*b*, are shortened.

Beginning with FIG. 7, the operation of one of the lower output receptacles 106*c*–106*h* will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. Pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIGS. 8 and 9 the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

Referring now to FIG. 15, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 (FIG. 9) to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

Referring now to FIG. 13, when the plunger assembly 300 is traveling upward out of the cassette 118, the rollers 316, 318 on the side arms 306, 308 engage the respective levers 216, 217 and move the respective levers 216, 217 from the second (open) position to the first (closed) position to move the gate 210 from the open position to the closed position as the paddle 302 ascends into the escrow compartment 116 after depositing the bills 204 in the storage cassette 118. The paddle 302 is mounted on the base 304 above the rollers 316, 318 on the side arms 306, 308 so that the paddle 302 clears the gate 210 before the gate 210 is moved to the closed position.

In alternative embodiments of the currency handling device 100, the output receptacles 106 can be sized to accommodate documents of varying sizes such as various international currencies, stock certificates, postage stamps, store coupons, etc. Specifically, to accommodate documents of different widths, the width of the escrow compartment 116, the gate 210, and the storage cassette 118 would need to be increased or decreased as appropriate. The document evaluation device 100 is sized to accommodate storage cassettes 118 and gates 210 of different widths. The entire transport mechanism 104 of the currency handling device 100 is dimensioned to accommodate the largest currency bills internationally. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may simply require the segregation of the U.S. currency from the French currency wherein the currency handling device 100 delivers U.S. currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c*and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, French currency is delivered to the fifth lower output receptacle 106*g*, and German currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*–106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggravate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*–106*h*. The currency handling device 100 which has eight output receptacles 106*a*–106*h* provides a great deal of flexibility to the user. And in other alternative embodiments of the currency handling device 100, numerous different combinations for processing documents are available.

According to one embodiment, the various operations of the currency handling device 100 are controlled by processors disposed on a number of printed circuit boards ("PCBs") such as ten PCBs located throughout the device 100. In one embodiment of the present invention, the processors are Motorola processors, model number 86HC16, manufactured by Motorola, Inc. of Schaumburg, Ill. Each of the processors are linked to a central controller via a general purpose communications controller disposed on each PCB. In one embodiment of the present invention the communications controller is an ARCNET communications controller, model COM20020, manufactured by Standard Microsystems Corporation of Hauppauge, N.Y. The communications controller enables the central controller to quickly and efficiently communicate with the various components linked to the PCBs.

According to one embodiment, two PCBs, a "motor board" and a "sensor board," are associated with each pair of lower output receptacles 106*c*–106*h*. The first two lower output receptacles 106*c,d*, the second two lower output receptacles 106*e,f*, and the last two lower output receptacles 106*g,h* are paired together. Each of the lower output receptacles 106 contain sensors which track the movement of the bills into the lower output receptacles 106*c*–106*h*, detect whether each storage cassette 118*a*–118*e* is positioned within the currency handling device 100, detect whether the doors 359 of the storage cassettes 118 are opened or closed, and whether the cassettes 118 are full. These aforementioned sensors associated with each pair of the lower output receptacles are tied into a sensor board which is linked to the central controller. The operation of the plunger assembly 300, the stacker wheels 202, the portion of transportation mechanism 104 disposed above the lower output receptacles 116*c*–116*h*, and the diverters 130 are controlled by processors disposed on the motor board associated with each pair of lower output receptacle's 106*c*–106*h*. Those sensors 130 which track the movement of bills along the transportation mechanism 104 that are disposed directly above the lower output receptacles 106*c*–106*h* are also tied into the respective motor boards.

One of the four remaining PCBs is associated with the operation of the one or two stacker wheels 127 associated with the upper output receptacles 106*a,b*, the stripping wheels 140, the primary drive motor of the evaluation region 108, a diverter which direct bills to the two upper output receptacles 106*a,b*, and the diverter which then directs bills between the two upper output receptacles 106*a,b*. The remaining three PCBs are associated with the operation of the transport mechanism 104 and a diverter which directs bills from the transport path to the bill facing mechanism 110. The plurality of sensors 130 disposed along the transport mechanism 104, used to track the movement of bills along the transport mechanism 104, also tied into these three remaining PCBs.

Referring now to FIGS. 19–22, a two belt bill facing mechanism 400 is illustrated. The two belt bill facing mechanism 400 is an alternative embodiment of the bill facing mechanism 110 referred to in FIGS. 1*a* and 1*b* and in the above related discussion. The two belt bill facing mechanism 400 can be used in conjunction with the currency handling device 100 shown in FIGS. 1*a* and 1*b* to rotate the orientation of a bill 401 approximately 180°. For example, if a U.S. bill, for example, is initially presented with the surface bearing a portrait of a president facing down, it may be directed to the two belt bill facing mechanism 400, whereupon it will be rotated 180° so that the bill surface with the portrait faces up. The decision may be taken to send a bill 401 to the facing mechanism 400 when the selected mode of operation or other operator instructions call for maintaining a given face orientation of bills as they are processed by the currency handling device 100. For example, it may be desirable in certain circumstances for all of the bills ultimately delivered to the lower output receptacles 106*c*–106*h* to have the same face orientation. In such embodiments of the currency handling device 100, the bill evaluation region 108 is capable of determining the face orientation of a bill, such that a bill not having the desired face orientation can first be directed to the two belt bill facing mechanism 400 before being delivered to the appropriate lower output receptacle 106*c*–106*h*.

The two belt bill facing mechanism 400 ("facing mechanism" ) includes a first belt 402 and a second belt 404. Each of the first and the second belts 402,404 forms a continuous loop. The belts 402,404 are disposed adjacent to each other such that the opposing surfaces of each belt 402,404 forms a bill facing transport path 406. The belts 402, 404 are twisted together so that an inlet 408 of the transport path 406 is rotated approximately 180° with respect to an outlet 410 of the transport path 406.

Figure 19:
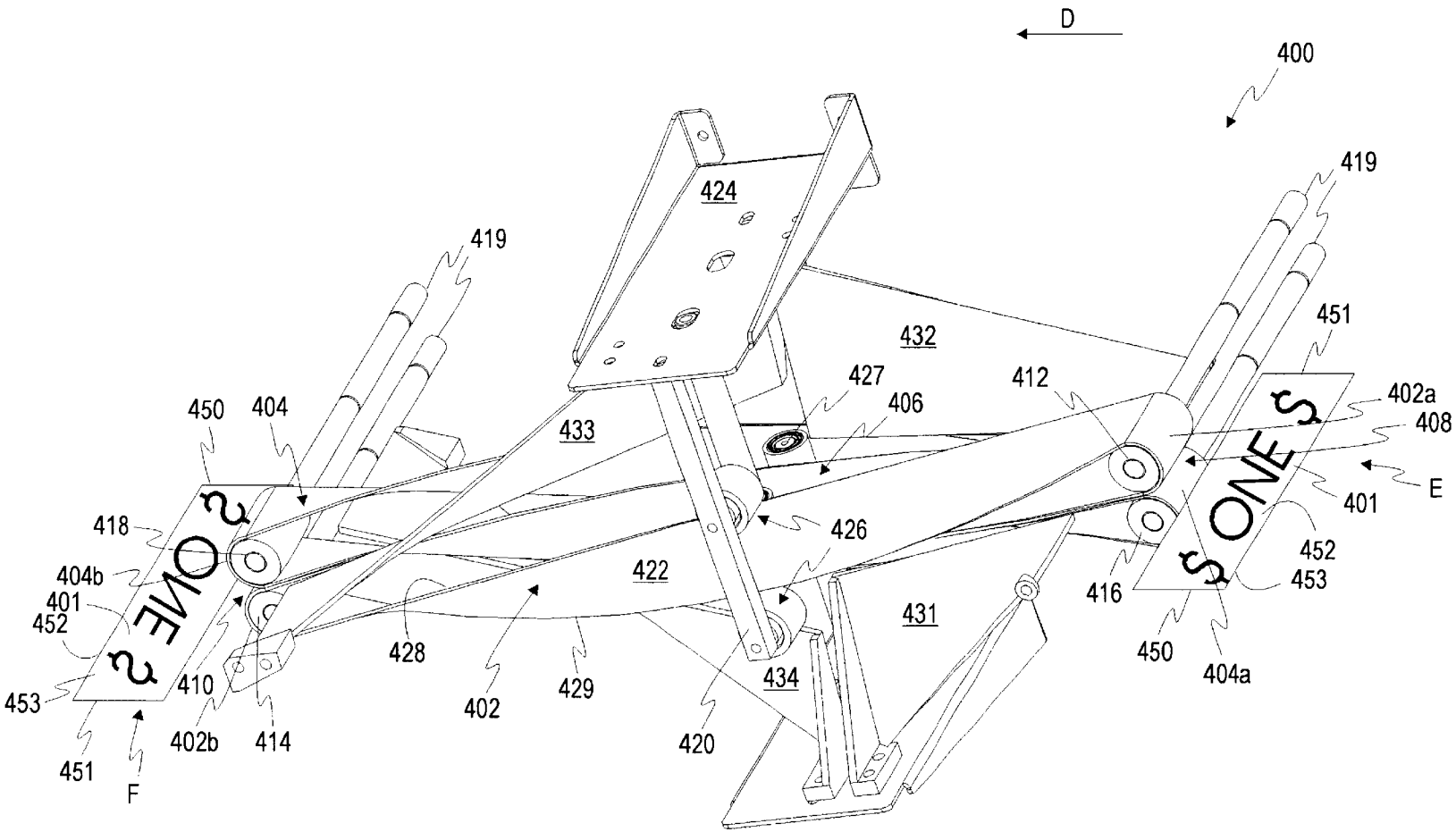
FIG. 19 is a perspective view of a two belt bill facing mechanism according to one embodiment of the present invention.

The first and second belts 402, 404 are each wrapped around two rollers. The first belt 402 is positioned around a first roller 412 disposed adjacent the inlet 408 and a second roller 414 disposed adjacent the outlet 410. The second belt 404 is positioned around a third roller 416 disposed adjacent the inlet 408 and a fourth roller 418 disposed adjacent the outlet 410. As illustrated in FIG. 19, the first and second rollers 412,414, associated with the first belt, are positioned such that the first roller 412 is the "top" roller at the inlet 408 and the second roller 414 is the "bottom" roller at the outlet 410. The third and forth rollers 416,418, associated with the second belt, are positioned such that the third roller 416 is the "bottom" roller at the inlet 408 and the forth roller 418 is the "top" roller at the outlet 410. This arrangement allows the for the "twisted" bill facing mechanism transport path 406. Starting from the inlet 408, a first end 402*a* of the first belt 402 is placed around the first roller 412 which is disposed above the third roller 416 around which a first end 404*a* of the second belt 404 is placed. Viewing FIG. 19 from right to left, the first and the second belts 402,404 are together twisted 180° out of the page. The second end 404*b* of the second belt 404 is now disposed above the second end 402*b* of the first belt 402. The second end 404*b* of the second belt 404 is positioned around the forth roller 418 and the second end 402*b* of the first belt 402 is positioned around the third roller 414. Between the inlet 408 and the outlet 410, that is between the rollers, there is no structure supporting the portions of the first or the second belts 402,404 which define the bill transport path 406. The rollers are connected to shafts 419 about which the rollers rotates. In one embodiment of the two belt bill facing mechanism, the rollers 414,418 are driven rollers and the rollers 412,416 are passive rollers. In such an embodiment, a motor (not shown) is coupled to the shafts 419 associated with driven rollers 414,418.

Figure 20:
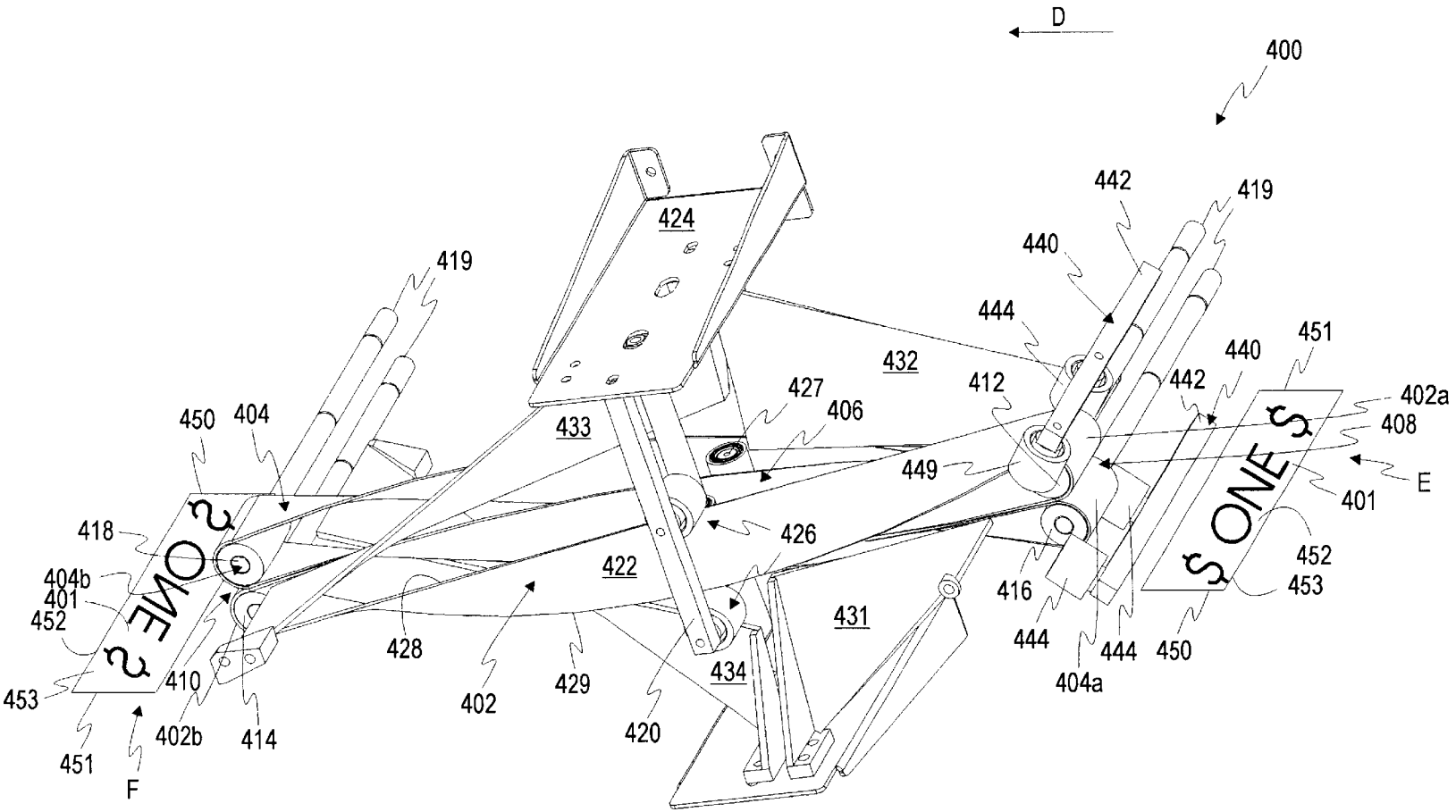
FIG. 20 is another perspective view of a two belt bill facing mechanism according to one embodiment of the document handling device of the present invention.
Figure 21:
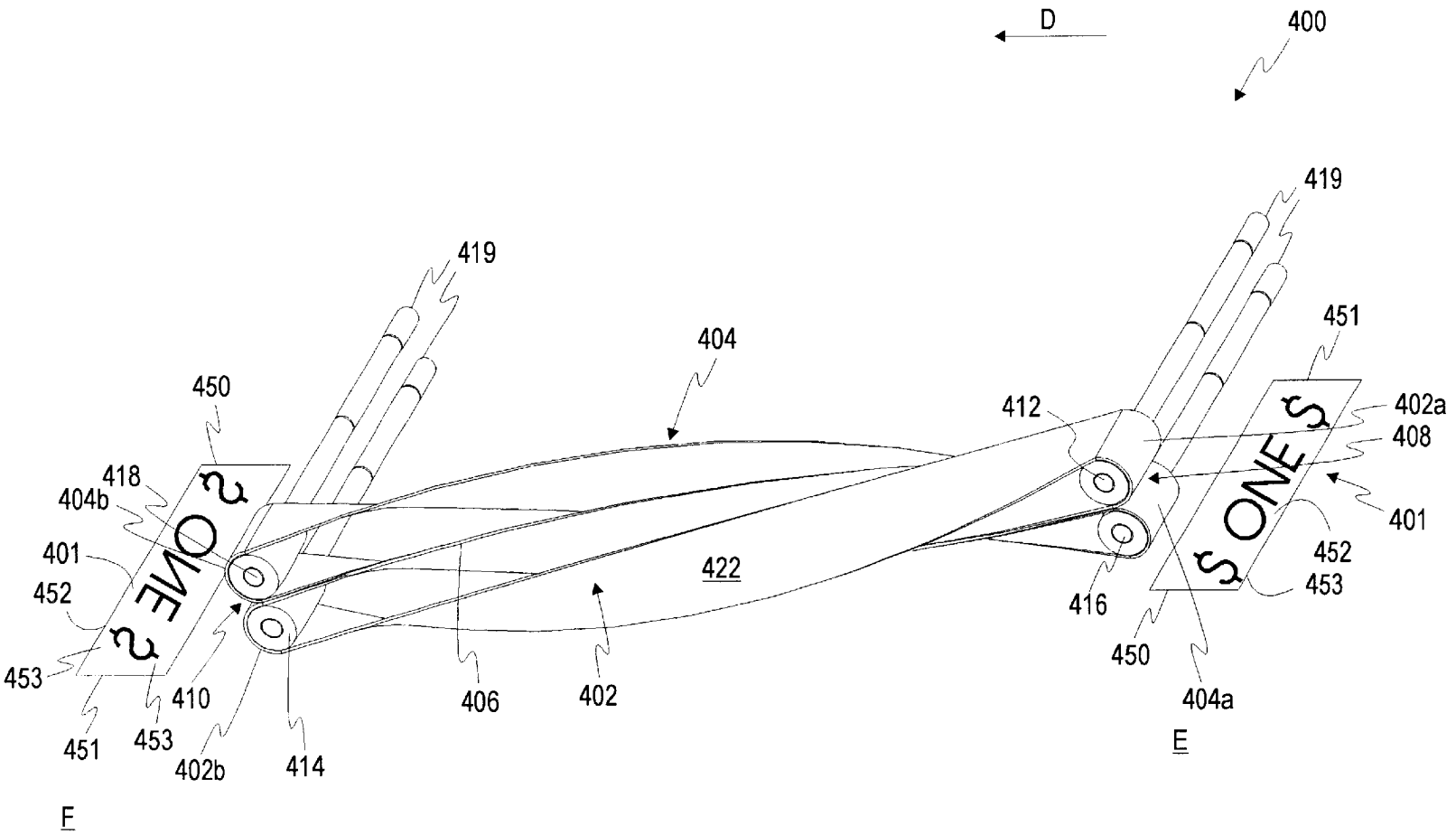
FIG. 21 is a perspective view of a two belt bill facing mechanism without belt guides or bill guides according to one embodiment of the document handling device of the present invention.
Figure 22:
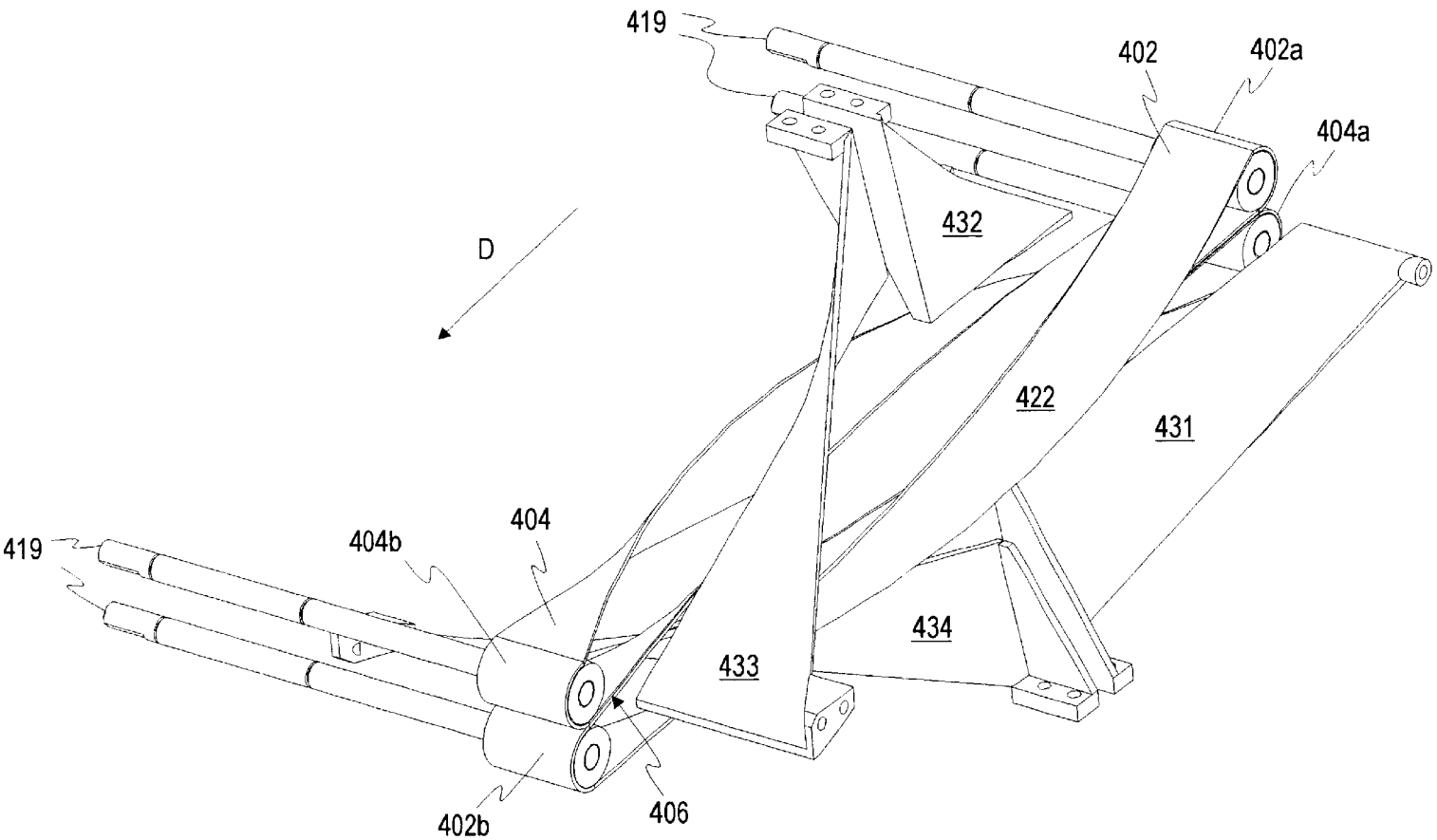
FIG. 22 is a perspective view of a two belt bill facing mechanism without belt guides according to one embodiment of the document handling device of the present invention.

Two belt guides 420 (FIGS. 19 and 20) are used to guide the portion of the belts not defining the transport path 406 or the return portion 422 of the belts away from the transport path. The return portion 422 of the belts 402,404 is drawn away from the transport path 406 to insure that the return portion 422 does not contact a bill 401 traveling along the transport path 406 causing the bill 401 to become skewed relative to the transport path 406. Each belt guide 420 is attached to a structure 424 which is fixed to the currency handling device 100. In FIGS. 19 and 20, only the first belt guide 420 is clearly illustrated. In the illustrated embodiment, each belt guide 420 includes one vertical roller and two horizontal rollers 426. The vertical roller associated with the second belt guide 420 is labeled with reference number 427. The interior of each belt 402,404 travels against the vertical roller. Any vertical movement of the return portion 422 of the belt is constrained by the two horizontal rollers 426 along which the edges 428,429 of the belts 402,404 travel. In an alternative embodiment, the belt guide 420 only contains one horizontal roller 426 to limit the vertical movement of the return portions of the belts.

In the embodiment illustrated in FIG. 20, the two belt bill facing mechanism contains belt end guides 440. The belt end guides 440 are used to maintain the position of belts 402,404 on rollers 412, 416. The belt guides limit any horizontal movement of the belts 402, 404 at their first ends 402*a*,404*b*. In another embodiment of the two, belt bill facing mechanism two more belt end guides are used to limit any horizontal of the belts 402,404 at the second ends 402*b*, 404*b*. The belt end guides 440 consists of a structure 442 and two rollers 444. Because the belt guides 420 pull the return portion 422 away from the transport path 406, the belt guide rollers 444 maintain the belt ends on the rollers 412, 414, 416, 418 and prohibit any movement of the belts 402,404 off of the rollers 412, 414,416,418.

The bill facing mechanism 400 also contains four guides 431,432,433, 434 disposed along the bill transport path 406. Each of these guides are also fixed to the structures 424. The guides 431–434 are made out of a rigid material. A bill is transported through the bill facing mechanism (as well as the through the transport mechanism 104 of currency handling device 100) with the leading edge of the bill being the long or wide edge of the bill 401. The width of the bill 401 is greater than the width of the first and the second belts 402,404 causing a significant portion of the bill 401 to overhang each edge of the belts 402,404. The function of the guides is to provide support to those portions of the bill 401 which overhang the belts 402,404. Because of the high processing rate at which the currency handling device 100 operates, a significant angular velocity is imparted to a bill directed through the facing mechanism. In alternative embodiments of the currency handling device 100, bills are processed at speeds in excess of 1200 bills per minute. The differences in air pressures acting on the front and the back surfaces areas of the bill 401 can cause the bill 401 to fold or be forced such that the bill is no longer being transported in a substantially flat manner. This situation can occur more readily when the bill stiffness is degraded due to bill wear resulting from heavy usage. Additionally, bills are often folded in a variety of manners which may cause a bill to be biased in a certain direction such that the bill will not lie flat under its own weight. It is preferable for the bill 401 to be transported through the bill facing mechanism 400 (and the currency handling device 100) in a substantially flat manner. If the bill 401 is not substantially flat when traveling from the outlet 410 of the bill facing mechanism 400 back into the bill transport mechanism 104 there is a possibility that the bill may become skewed at the interface between the outlet 410 and the transport mechanism 104 because the transport mechanism 104 may not "catch" the entire leading edge of the bill.

In operation, a bill 401, shown in position E, enters the inlet 408 of the bill facing mechanism 400 and is transported along the bill facing transport path 406 in a direction from right to left indicated by arrow D. The bill 401 adjacent to the outlet 410 is shown in position F which is a 180° rotation from position E. Referring to the bill 401 in position E, the bill 401 has narrow edges 450,451 and surfaces 452, 453. The first and second belts 402,404, a portion of which define the transport path 406, are twisted causing the bill 401 to rotate in manner such that the (near) edge 450 of the bill 401 drops into the page and the (far) edge 451 of the bill 401 rotates up and out of the page. As the bill 401 travels through the bill transport path 406, the surface 452 towards the (near) edge 450 of the bill 401 is guided by the first guide 431. The surface 453 towards the (far) edge 451 of the bill 401 is supported by the second guide 432. The guides 431,432 support their respective surfaces of the bill 401 until the bill 401 is substantially in a vertical position. As the bill continues to travel towards the outlet 410 the edge 451 (now at the top of the page) continues to rotate out of the page while the edge 450 (now at the bottom of the page) rotates into the page. Continuing, the surface 453 towards the edge 451 is being guided by the guide 433. The surface 452 towards edge 450 is being guided by the guide 434. When the bill arrives at the outlet 410, the orientation of the bill has been rotated 180°. The bill then merges into the transport mechanism 104 of the currency handling device 104.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A currency evaluation device for receiving a plurality of currency bills and rapidly evaluating each of the bills, the device comprising:

an input receptacle adapted to receive a plurality of bills to be evaluated;

one or more output receptacles adapted to receive the bills after the bills have been evaluated;

a transport mechanism adapted to transport the bills, one at a time along a transport path, from the input receptacle to the one or more output receptacles;

a bill facing mechanism disposed along the transport path between the input receptacle and the output receptacles, the bill facing mechanism including a first and a second belt having a first end and a second end, each of the first and the second belts forming a continuous loop, each of the first and the second belts having an outer surface, the first belt being disposed adjacent to the second belt wherein a portion of the outer surfaces of the first and second belts define a bill facing path, the bill facing path having an inlet corresponding to the first end of the first and the second belts and an outlet corresponding to the second ends of the first and the second belts, the first and the second belts being twisted together causing the second ends of the first and second belts to be twisted approximately 180° with respect to the first ends of the first and the second belts causing the outlet of the bill facing path to be twisted approximately 180° with respect to the outlet of the bill facing path, the bill facing mechanism including a plurality of guides disposed adjacent to the bill facing path, the plurality of guides being adapted to support the outer portions of the bill which extend beyond a width of the first and the second belts as the bill is being transported along the bill facing path;

an evaluating unit adapted to determine information concerning the bills, the evaluation unit having at least one sensor positioned along the transport path between the input receptacle and the output receptacles;

an operator interface adapted to receive operational instructions from a user and to display the information concerning the bills; and a controller adapted to couple the operator interface and the evaluation unit, the controller causing the discriminating unit to operate in one of a plurality of operating modes which determine into which of the one or more output receptacles each bill is delivered in response to the operational instructions from the user.

2. The device of claim 1 wherein at least one of one or more output receptacles includes a first compartment and a second compartment, the at least one output receptacle having a gate disposed between the first compartment and the second compartment, the gate having an open position and a closed position, the gate being adapted to form a bill supporting surface when in the closed position, the gate having at least one lever outwardly extending therefrom, the lever being in a first position when the gate is in the closed position and the lever being in a second position when the gate is in the open position.

3. The device of claim 1 wherein the first belt includes a return portion, the device further comprising a first belt guide being adapted to guide the return portion of the first belt away from the bill facing path.

4. The device of claim 3 wherein the second belt includes a return portion, the device further comprising a second belt guide being adapted to guide the return portion of the second belt away from the bill facing path.

5. The device of claim 1 further comprising a first pair of rollers, one of the first pair of rollers being disposed adjacent the inlet, the other of the first pair of rollers being disposed adjacent the outlet, the first belt being disposed around the first pair of rollers.

6. The device of claim 5 further comprising a second pair of rollers, one of the second pair of rollers being disposed adjacent the inlet, the other of the second pair of rollers being disposed adjacent the outlet, the second belt being disposed around the first pair of rollers.

7. A currency evaluation device for receiving a plurality of currency bills and rapidly evaluating each of the bills, the device comprising:

an input receptacle adapted to receive a plurality of bills to be evaluated;

a plurality of output receptacles adapted to receive the bills after the bills have been evaluated;

a transport mechanism adapted to transport the bills, one at a time along a transport path, from the input receptacle to the plurality of the output receptacles;

a bill facing mechanism disposed along the transport path between the input receptacle and the output receptacles, the bill facing mechanism comprising:

a first belt having a bill transport portion and a return portion, the first belt having a first end and second end, the second end of first belt being twisted approximately 180° in relation to the first end of the first belt;

a second belt having a bill transport portion and a return portion, the second belt having a first end and second end, the bill transport portion of the first belt being disposed adjacent to the bill transport portion of the second belt, the second end of the second belt being twisted approximately 180° in relation to the first end of the second belt;

a bill facing path defined by the bill transport portions of the first and the second belts, the bill facing path having an inlet and an outlet, wherein the outlet of the bill facing path is twisted approximately 180° in relation to the inlet; and a plurality of guides disposed adjacent to the bill facing path, the plurality of guides being adapted to support the outer portions of the bill which extend beyond a width of the first and the second belts as the bill is being transported along the bill facing path;

an evaluating unit adapted to determine information concerning the bills, the evaluation unit having at least one sensor positioned along the transport path between the input receptacle and the output receptacles;

an operator interface adapted to receive operational instructions from a user and to display the information concerning the bills; and a controller adapted to couple the operator interface and the evaluation unit, the controller causing the evaluating unit to operate in one of a plurality of operating modes.

8. The device of claim 7 wherein the bill facing mechanism further comprises a first pair of rollers, one of the first pair of rollers being disposed adjacent the inlet, the other of the first pair of rollers being disposed adjacent the outlet, the first belt being disposed around the first pair of rollers.

9. The device of claim 8 wherein the bill facing mechanism further comprises a second pair of rollers, one of the second pair of rollers being disposed adjacent the inlet, the other of the second pair of rollers being disposed adjacent the outlet, the second belt being disposed around the second pair of rollers.

10. The device of claim 7 wherein the bill facing mechanism further comprises a first belt guide being adapted to guide the return portion of the first belt away from the bill facing path.

11. The device of claim 10 wherein the bill facing mechanism further comprises a second belt guide being adapted to guide the return portion of the second belt away from the bill facing path.

12. The device of claim 7 wherein the first belt comprises a continuous loop.

13. The device of claim 7 wherein the second belt comprises a continuous loop.

14. A currency evaluation device for receiving a plurality of currency bills and rapidly evaluating each of the bills, the device comprising:

an input receptacle adapted to receive a plurality of bills to be evaluated;

a plurality of output receptacles adapted to receive the bills after the bills have been evaluated;

a transport mechanism adapted to transport the bills, one at a time along a transport path, from the input receptacle to the plurality of the output receptacles;

a bill facing mechanism disposed along the transport path between the input receptacle and the output receptacles, the bill facing mechanism being adapted to rotate the orientation of a bill approximately 180° , the bill facing mechanism comprising:

a bill facing path having an inlet and an outlet, the bill facing path being adapted to transport a bill from the inlet to the outlet, the bill facing path being defined by opposing surfaces of a first and a second belt, the first and second belts each having a first and a second end, the second end of the first and second belts being twisted approximately 180° in relation to the first end of the first and second belts, wherein the inlet of the bill facing path is rotated approximately 180° in relation to the outlet;

a first pair of rollers, one of the first pair of rollers being disposed adjacent the inlet, the other of the first pair of rollers being disposed adjacent the outlet, the first belt being disposed around the first pair of rollers; and a second pair of rollers, one of the second pair of rollers being disposed adjacent the inlet, the other of the second pair of rollers being disposed adjacent the outlet, the second belt being disposed around the first pair of rollers;

an evaluating unit adapted to determine information concerning the bills, the evaluation unit having at least one sensor positioned along the transport path between the input receptacle and the output receptacles;

an operator interface adapted to receive operational instructions from a user and to display the information concerning the bills; and a controller adapted to couple the operator interface and the evaluation unit, the controller causing the evaluating unit to operate in one of a plurality of operating modes.

15. The device of claim 14 wherein the first belt includes a return portion, and wherein the bill facing mechanism further comprises a first belt guide adapted to guide a portion of the first belt not defining the bill facing path away from the bill facing path.

16. The device of claim 15 wherein the second belt includes a return portion, and wherein the bill facing mechanism further comprises a second belt guide being adapted to guide a portion of the second belt not defining the bill facing path away from the bill facing path.

17. The device of claim 14 wherein the first belt forms a continuous loop.

18. The device of claim 14 wherein the second belt forms a continuous loop.

* * * * *

UNITED STATES PATENT AND TRADEMARK OFFICE

CERTIFICATE OF CORRECTION

PATENT NO. : 6,371,303 B1 
DATED : April 16, 2002
INVENTOR(S) : Robert J. Klein, George T. Seelenbinder and Charles P. Jenrick It is certified that error appears in the above-identified patent and that said Letters Patent is hereby corrected as shown below:

Title page,
Item [57], ABSTRACT,
Line 1, delete "includes" replace with -- comprises --

Column 20,
Line 9, delete "outlet" replace with -- input --

Signed and Sealed this

Twenty-sixth Day of August, 2003

JAMES E. ROGAN
*Director of the United States Patent and Trademark Office*